US008119941B2

(12) United States Patent
Lipp et al.

(10) Patent No.: US 8,119,941 B2
(45) Date of Patent: Feb. 21, 2012

(54) APPLIANCE TIMER

(75) Inventors: Ellis P. Lipp, Charlottesville, IN (US); Gregory A. Peterson, South Barrington, IL (US); Peter F. Stultz, Elgin, IL (US)

(73) Assignee: Nidec Motor Corporation, St. Louis, MO (US)

( * ) Notice: Subject to any disclaimer, the term of this patent is extended or adjusted under 35 U.S.C. 154(b) by 1331 days.

(21) Appl. No.: 11/678,645

(22) Filed: Feb. 26, 2007

(65) Prior Publication Data

US 2008/0017484 A1 Jan. 24, 2008

Related U.S. Application Data

(60) Provisional application No. 60/832,367, filed on Jul. 21, 2006.

(51) Int. Cl.
*H01H 19/00* (2006.01)

(52) U.S. Cl. ..... 200/19.18; 200/19.2

(58) Field of Classification Search ..... 200/300, 200/19.18, 19.2
See application file for complete search history.

(56) References Cited

U.S. PATENT DOCUMENTS 4,577,179 A * 3/1986 Chambers et al. ..... 340/309.8
4,657,407 A * 4/1987 Lewis ..... 368/184
5,889,255 A * 3/1999 Bogart et al. ..... 219/121.65
6,862,482 B2 * 3/2005 Peterson et al. ..... 700/19

* cited by examiner

*Primary Examiner* — Renee Luebke
*Assistant Examiner* — Lheiren Mae Caroc
(74) *Attorney, Agent, or Firm* — Maginot, Moore & Beck, LLP

(57) ABSTRACT

An appliance timer operable in a selection mode and an operation mode includes a shaft assembly, a switch assembly, a cam device, a bi-directional motor, and a display device. The shaft assembly is operable to select an operation cycle and to drive the display device in the selection mode. The motor rotates in a first rotational direction and a second rotational direction opposite to the first rotational direction in the operation mode. When the motor rotates in the first rotational direction, the motor drives the cam device to operate the switch assembly to actuate or deactivate a plurality of electrical circuits associated with a plurality of appliance functions. When the motor rotates in the second rotational direction, the motor drives the display device to indicate an operational status of the appliance. The rotation of the motor is controlled by a microprocessor.

23 Claims, 26 Drawing Sheets

APPLIANCE TIMER

CROSS-REFERENCE TO RELATED APPLICATIONS

This application claims the benefit of U.S. Provisional Application No. 60/832,367, filed on Jul. 21, 2006. The disclosure of the above application is incorporated herein by reference.

FIELD

The present disclosure relates generally to appliances, and more particularly to appliance timers.

BACKGROUND

The statements in this section merely provide background information related to the present disclosure and may not constitute prior art.

Appliances, such as washing machines, dishwashers and microwave ovens, generally include a timer to allow a user to select an appliance function, a program interval for the appliance function, and/or a desired operation cycle. A typical electromechanical timer for a washing machine generally includes a rotary knob for selecting a preferred washing cycle, a cam operatively connected to a plurality of switching arms for opening and closing various electrical circuits associated with the switching arms, and a motor for driving the cam. When a user pushes the control knob, the control knob can be rotated to a plurality of positions corresponding to a plurality of washing cycles or appliance functions, and the cam is rotated by the control knob to a proper start position. When the control knob is pulled out, the washing machine starts to run and the motor drives the cam so that the switch arms are raised or lowered for closing or opening the associated electrical circuits in accordance with a predefined pattern defined by the elevation of the cam surfaces.

In the typical electromechanical timer, the various electrical circuits associated with the various appliance functions are completely controlled by the predefined pattern on the cam surfaces. Therefore, designing or programming the cam is complex and a cam with a predefined pattern is only suitable for a washing cycle. When a new washing cycle is desired, redesigning the cam is necessary. Moreover, due to the complex nature of the cam designing and cam control, it is difficult to precisely control the various appliance functions. For example, it is difficult to use the cam to precisely control the temperature of water and the period of adding warm water without wasting energy. Therefore, the typical electromechanical timer does not meet the increasing demand for energy-saving operation of the appliance.

Electronic devices have been used to replace the cam for a more precise control and easy programming of various appliance functions. The ability of the electronic devices to precisely control the various appliance functions meets the need for energy saving. In addition, reprogramming the electronic devices is much easier and more cost effective than redesigning a cam when a new washing cycle is desired.

An electronic timer, however, can incorporate many costly relays in the various electric circuits and is thus more expensive than an electromechanical timer. Further, an electronic timer generally includes a plurality of touch pads for setting the various appliance functions, and increases the level of complexity to operate when compared to a rotary knob used in the electromechanical timer. The rotary knob provides a familiar tactile and visual feedback to consumers and operates in a manner instinctively known to consumers from years of use.

SUMMARY

In one preferred form, a timer comprises a switch assembly for controlling a plurality of appliance functions, a display device, and a bi-directional motor for operating the switch assembly and the display device. When the motor rotates in a first rotational direction, the motor operates the switch assembly. When motor rotates in a second rotational direction opposite to the first rotational direction, the motor operates the display device.

In another preferred form, a data input and display system for a timer operable in a selection mode and an operation mode is provided. The data input and display system comprises a display device, a shaft assembly and a clutch. The display device includes a plurality of positions corresponding to a plurality of appliance functions. The shaft assembly is operable to select an operation cycle in the selection mode. The clutch is adapted to connect a switch assembly and a motor. When the data input and display system is in the selection mode, the clutch disengages the display device. When the data input and display system is in the operation mode, the clutch engages the display device.

In yet another form, a shaft assembly for securing a knob is provided. The shaft assembly comprises a hollow shaft body including a locking member. The locking member is movable between a deflected position where the hollow shaft body can be inserted into an insertion hole of the knob and an undeflected position where the locking member locks the knob.

In still another form, a shaft assembly for securing a knob is provided. The shaft assembly comprises a hollow shaft body including a locking member. The locking member is movable between an undeflected position where the hollow shaft body can be inserted into an insertion hole of the knob, and a deflected position where the locking member locks the knob.

In still another form, a selector for a timer is provided. The selector comprises a shaft assembly and a knob. The shaft assembly includes a hollow shaft body and a retaining member. The hollow shaft body has a locking member. The retaining member is disposed within the hollow shaft body and movable axially relative to the hollow shaft body. The knob is removably mounted to the locking member. When the retaining member is moved to a first axial position, the knob is locked by the locking member. When the retaining member is moved to a second axial position, the knob can be removed from the locking member.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
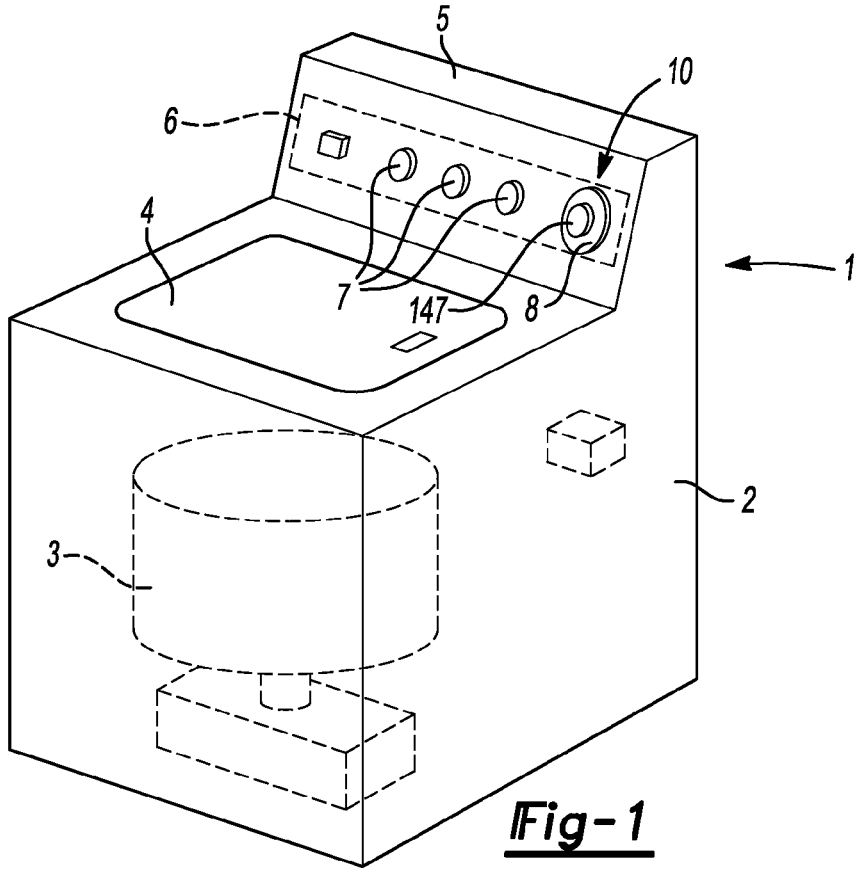
FIG. 1 is a perspective view of a washing machine embodying a timer in accordance with the teachings of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a washing machine is generally indicated by reference numeral 1, which represents one form of a laundry appliance. The washing machine 1 has a frame 2 that houses a receptacle or tub 3 that is configured to receive laundry therein for washing. The tub 3 is accessed via a pivoting door or lid 4. The washing machine 1 has a control panel frame 5 that houses an appliance control system 6. A plurality of auxiliary inputs 7 and a timer 10 are mounted on the control panel frame 5 for selecting and modifying a desired washing cycle. The timer 10 includes a control knob 147 for operating the timer 10 and a display device 8, such as a dial skirt, for indicating the selected washing cycle.

Figure 2:
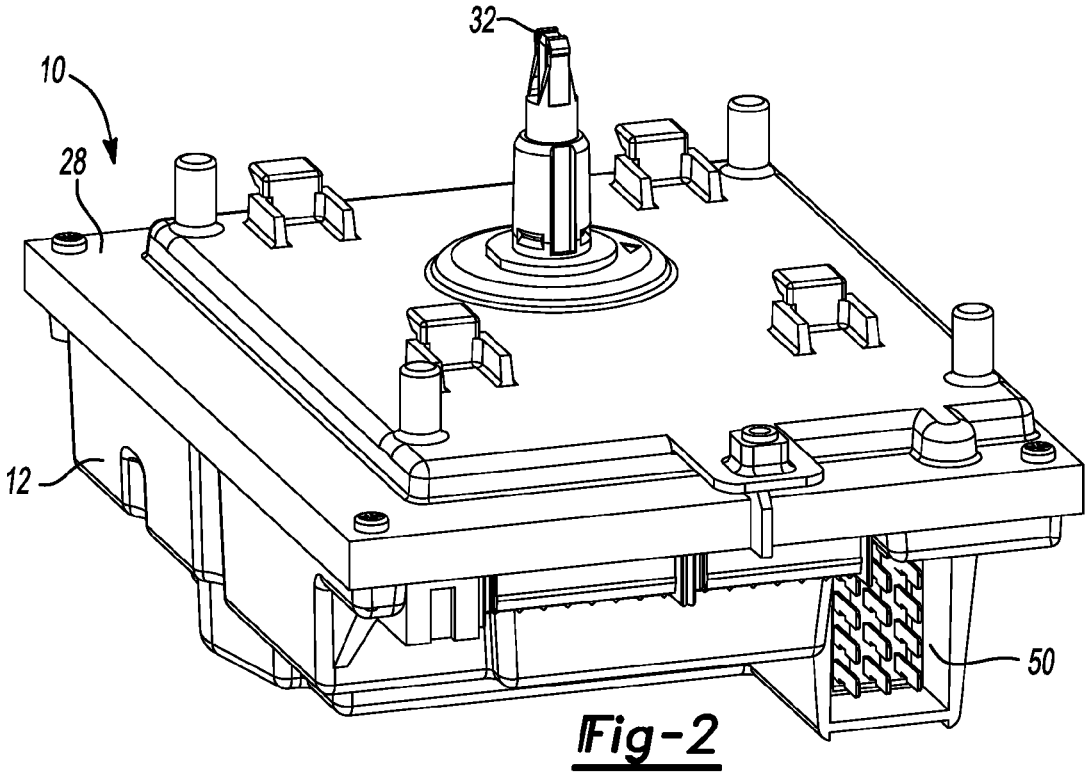
FIG. 2 is a top perspective view of a timer constructed in accordance with the teachings of the present disclosure.
Figure 3:
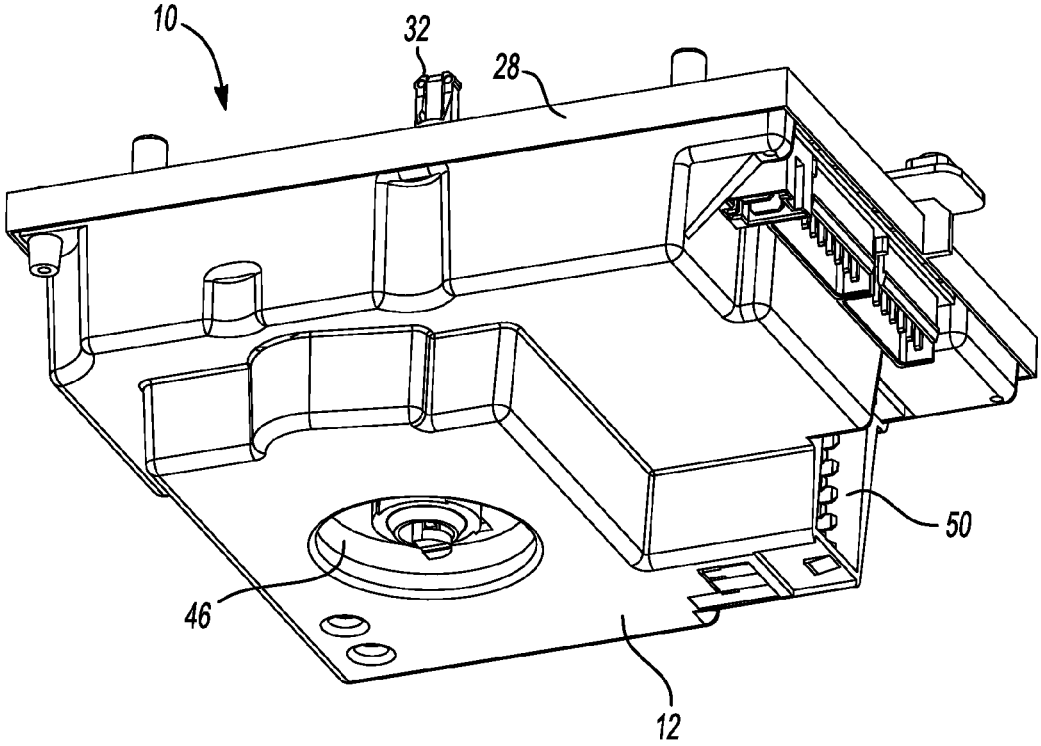
FIG. 3 is a bottom perspective view of the timer of FIG. 2.
Figure 4:
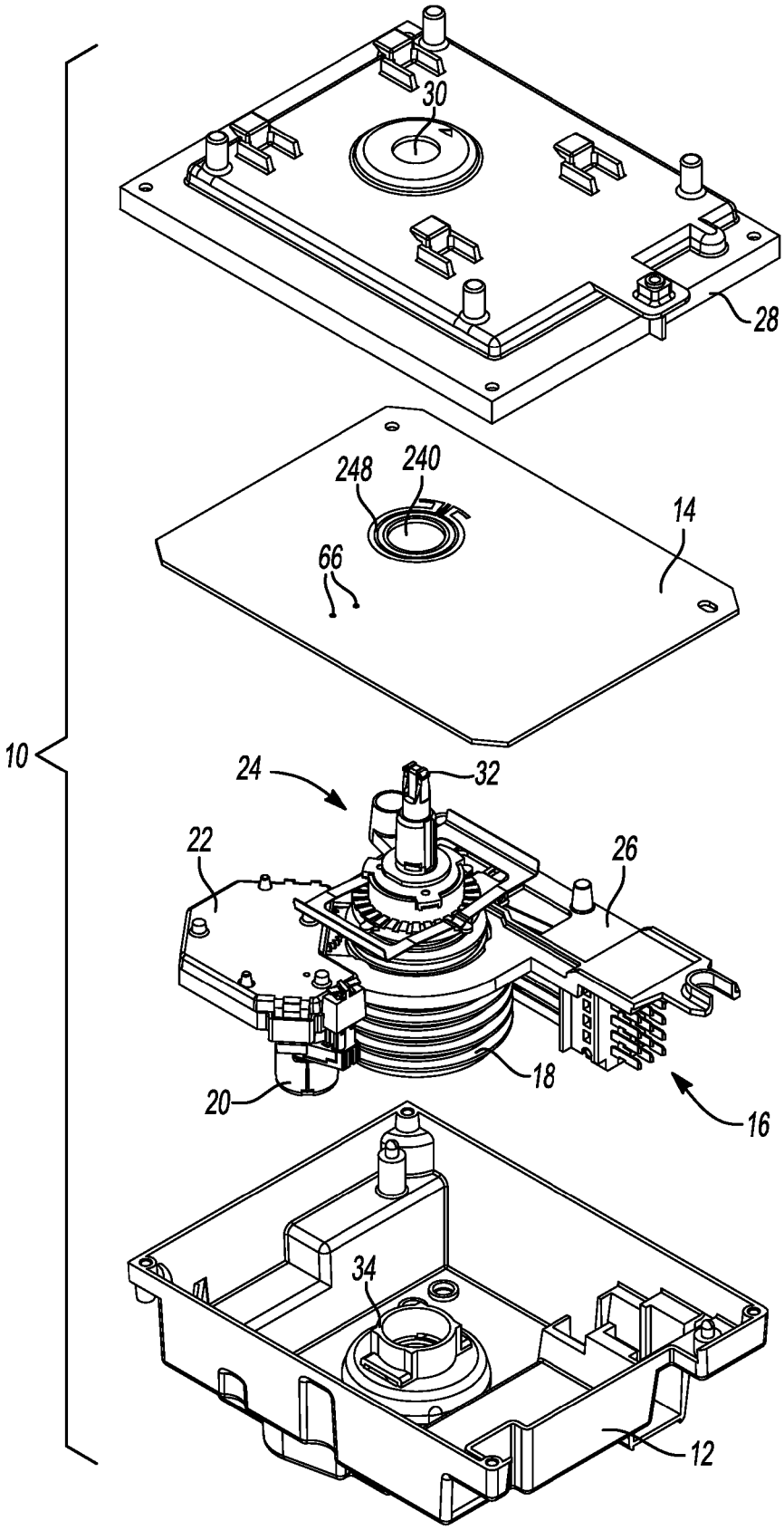
FIG. 4 is a partial exploded view of the timer of FIG. 2.

Referring to FIGS. 2 to 4, the timer 10 for the washing machine 1 constructed in accordance with the teachings of the present disclosure includes a housing 12 for receiving therein various timer components, including a printed circuit board 14, a switch assembly 16, a cam device 18, a motor 20, a gear train 22, and a driving mechanism 24. The timer 10 further includes a support plate 26 for supporting the motor 20 and the gear train 22, and a cover 28 for closing the housing 12. The cover 28 includes a hole 30 for allowing a shaft assembly 32 of the driving mechanism 24 to pass through.

Figure 5:
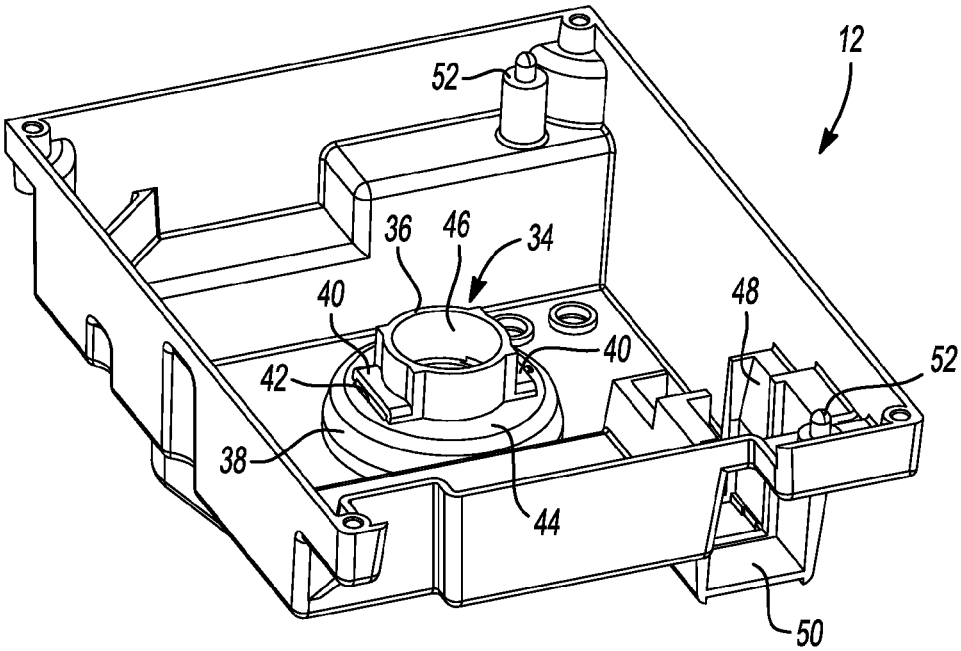
FIG. 5 is a perspective view of a housing of the timer of FIG. 2.
Figure 6:
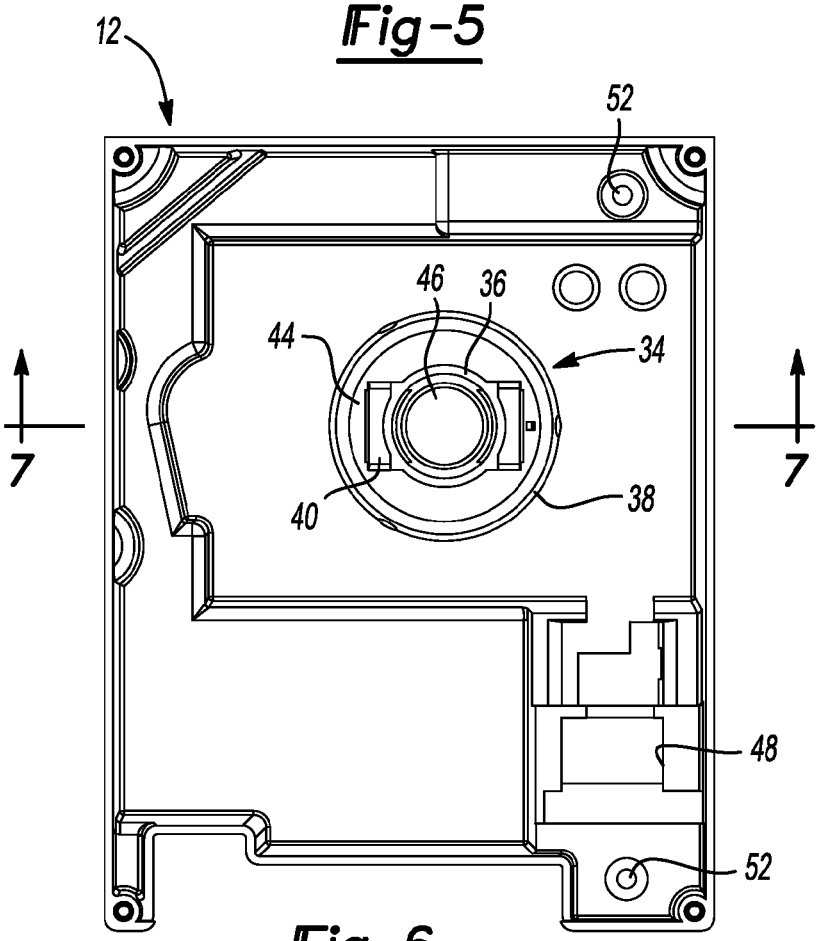
FIG. 6 is a top view of the housing of FIG. 5.
Figure 7:
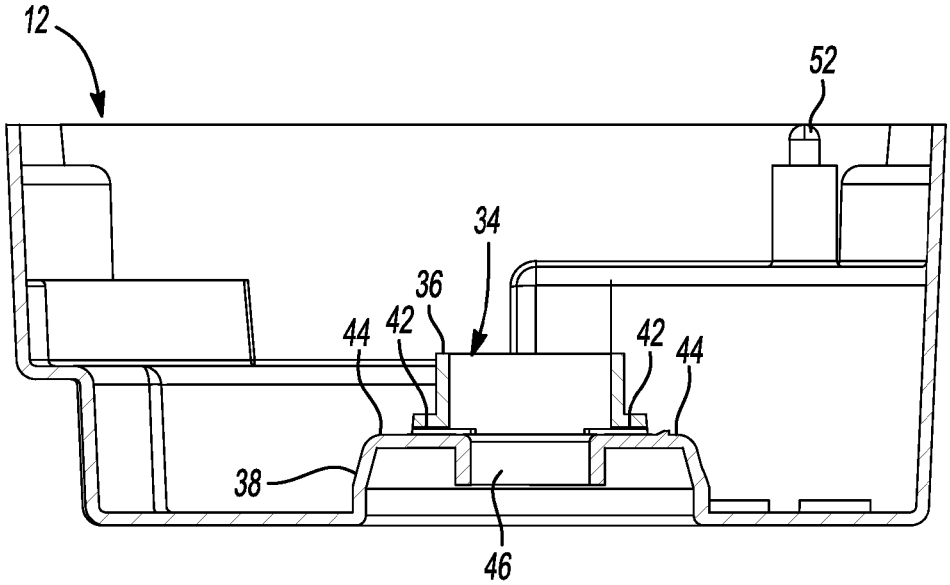
FIG. 7 is a cross-sectional view of the housing, taken along line 7-7 of FIG. 6.

Referring to FIGS. 5-7, the housing 12 includes a hollow boss 34 for positioning the cam device 18 in the housing 12. The boss 34 includes an upper cylindrical portion 36, a lower cylindrical portion 38 and a pair of flanges 40 disposed between the upper cylindrical portion 36 and the lower cylindrical portion 38. The lower cylindrical portion 38 has an outside diameter larger than that of the upper cylindrical portion 36. The flanges 40 are disposed diametrically from the upper cylindrical portion 36 and define a pair of slots 42 adjacent to a top surface 44 of the lower cylindrical portion 38. The upper cylindrical portion 36 and the lower cylindrical portion 38 define a hollow space 46.

As shown in FIG. 5, the housing 12 includes a seat 48 for positioning the switch assembly 16. The seat 48 has an opening 50 to allow the switch assembly 16 to extend outwardly of the housing 12 to connect a plurality of electrical circuits (not shown) associated with a plurality of appliance functions. The housing 12 further includes positioning posts 52 for positioning and engaging the support plate 26.

Figure 8:
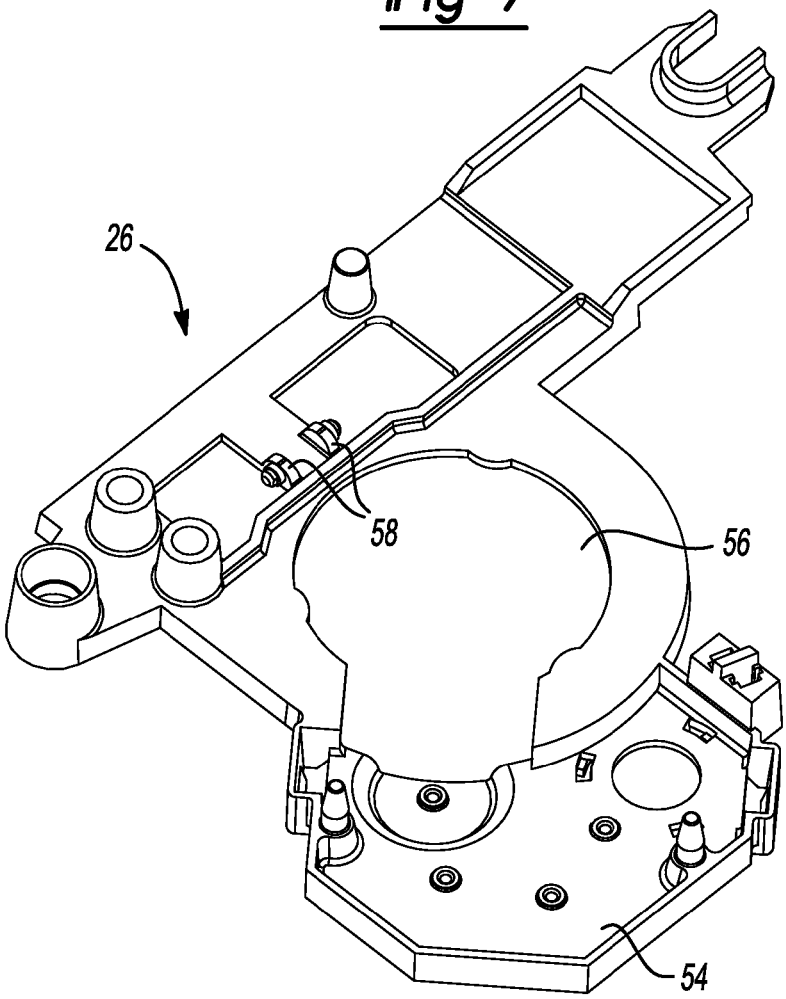
FIG. 8 is a top perspective view of a support plate.

Referring to FIG. 8, the support plate 26 includes a recess 54 for receiving and supporting the motor 20 and the gear train 22. A central passage 56 is defined in the support plate 26 adjacent to the recess 54 to allow the shaft assembly 32 of the driving mechanism 24 to pass through. The support plate 26 further includes a hinge 58 adjacent to the central passage 56.

Figure 9:
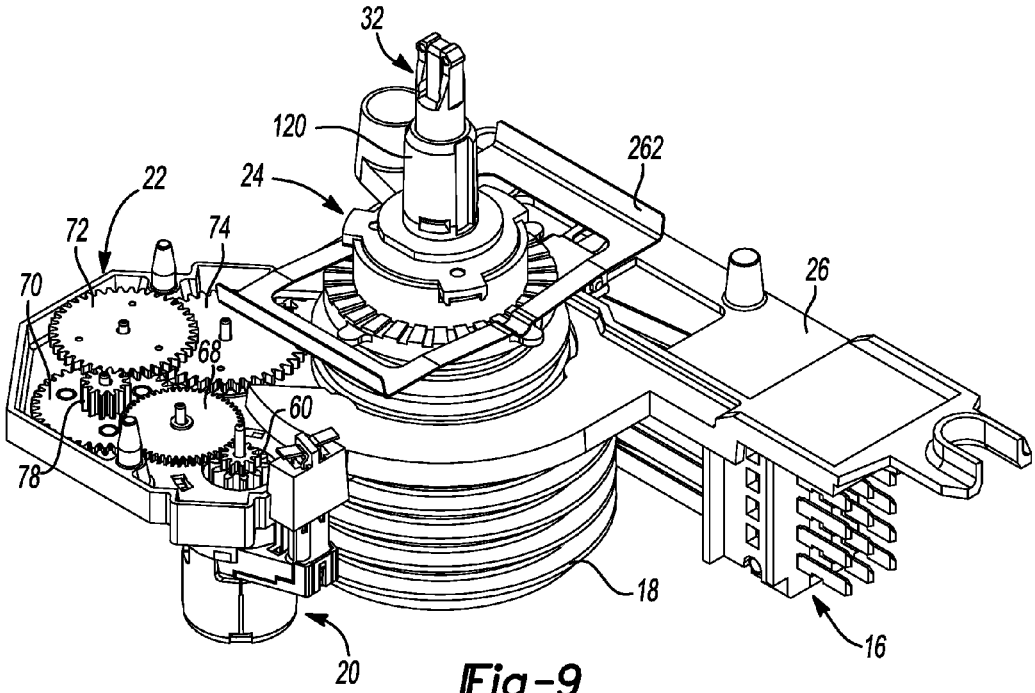
FIG. 9 is a perspective view of the timer, wherein the housing, the cover, and the printed circuit board are removed for clarity.

As shown in FIG. 9, the motor 20 and the gear train 22 are supported by the support plate 26, where the gear train 22 is disposed between the motor 20 and the driving mechanism 24. The cam device 18 and the switch assembly 16 are disposed under the support plate 26 with the switch assembly 16 attached to the cam device 18.

Figure 10:
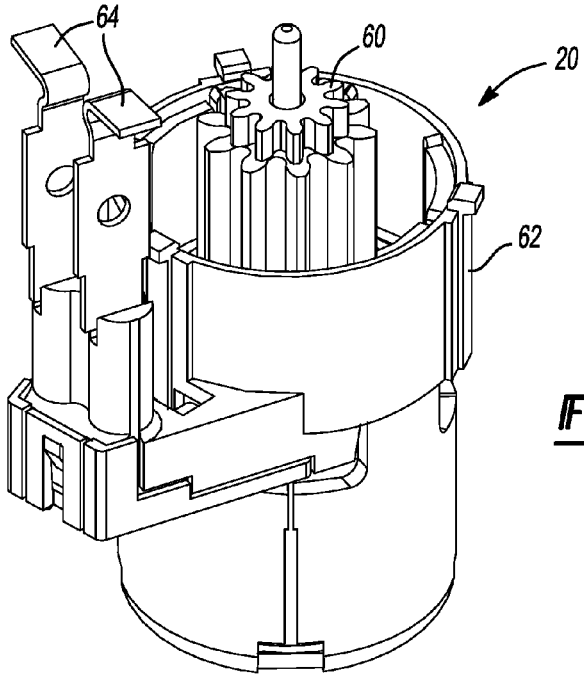
FIG. 10 is a perspective view of a motor.

Referring to FIG. 10, the motor 20 has a splined rotor 60, a stator 62, and a pair of terminals 64 extending upwardly to corresponding pin holes 66 (shown in FIG. 4) of the printed circuits board 14 for connecting to a microprocessor (not shown) through interface circuitry on the printed circuit board 14. The terminals 64 are spring-loaded to contact rivets (not shown) disposed in the pin holes 66 on the printed circuit board 14. The motor 20 is a bi-directional motor and is controlled by the microprocessor.

Figure 11:
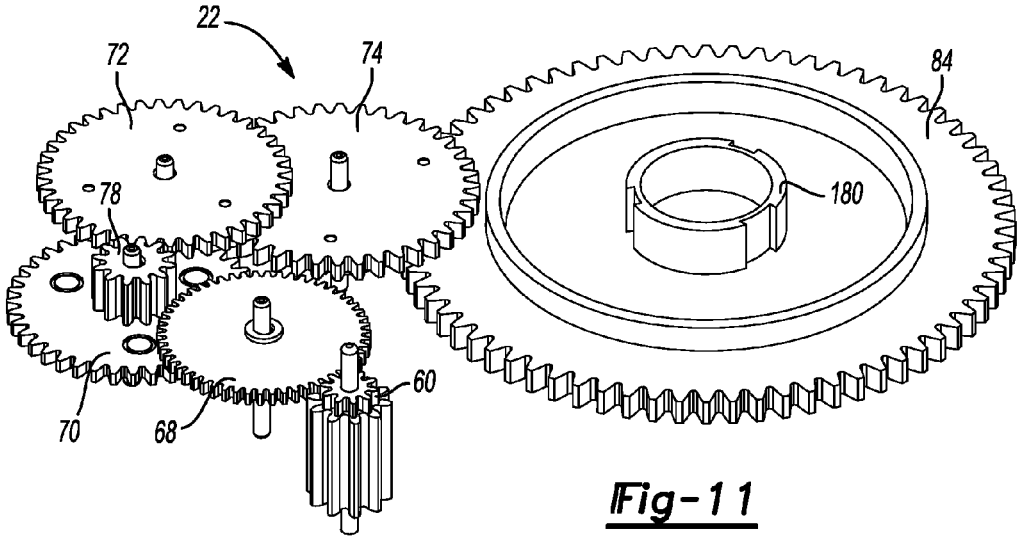
FIG. 11 is a top perspective view of a rotor of the motor, a gear train and a driving wheel.
Figure 12:
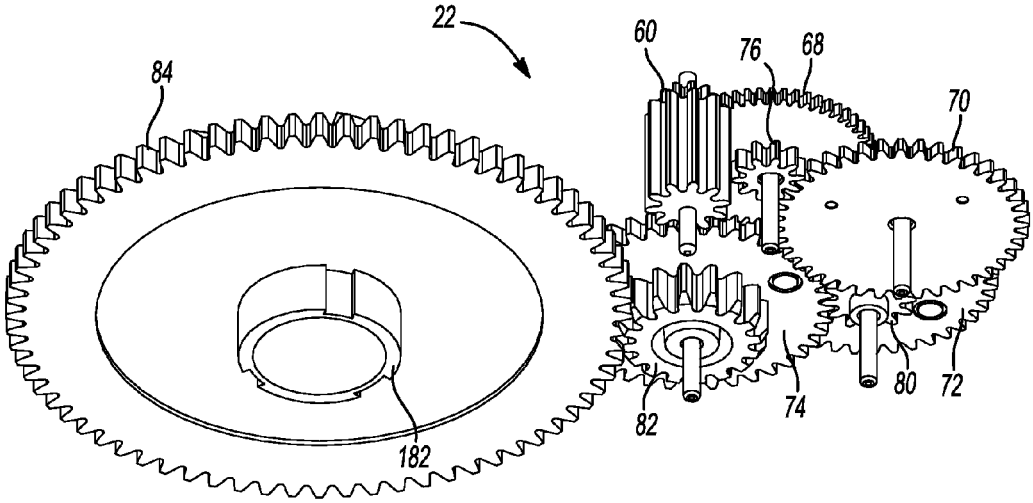
FIG. 12 is a bottom perspective view of the rotor of the motor, the gear train and the driving wheel of FIG. 11.

Referring to FIGS. 11 and 12, the gear train 22 includes four gears 68, 70, 72 and 74 and four coaxially-disposed pinions 76, 78, 80 and 82. The gear train 22 meshes with the splined rotor 60 of the motor 20 and a driving wheel 84 of the driving mechanism 24 for transmitting a torque from the splined rotor 60 to the driving wheel 84. The driving wheel 84 in turn drives the cam device 18 below or a display device 8 above, depending on the rotation of the motor 20, which will be described in more detail later. The arrangement of the gear train 22 in FIGS. 11 and 12 causes the driving wheel 84 to rotate in a direction opposite to that of the motor 20.

Figure 13:
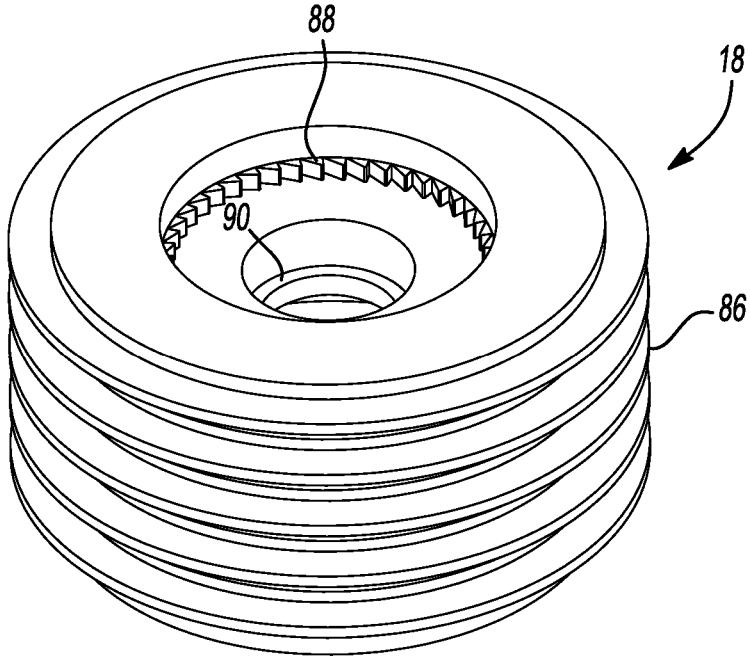
FIG. 13 is a perspective view of a cam device.
Figure 14:
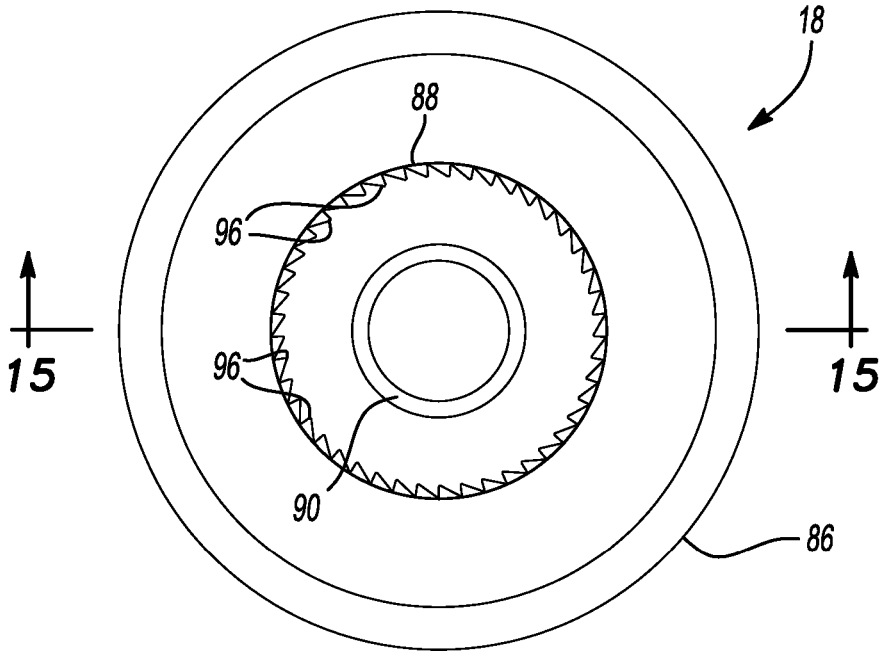
FIG. 14 is a top view of the cam device of FIG. 13.
Figure 15:
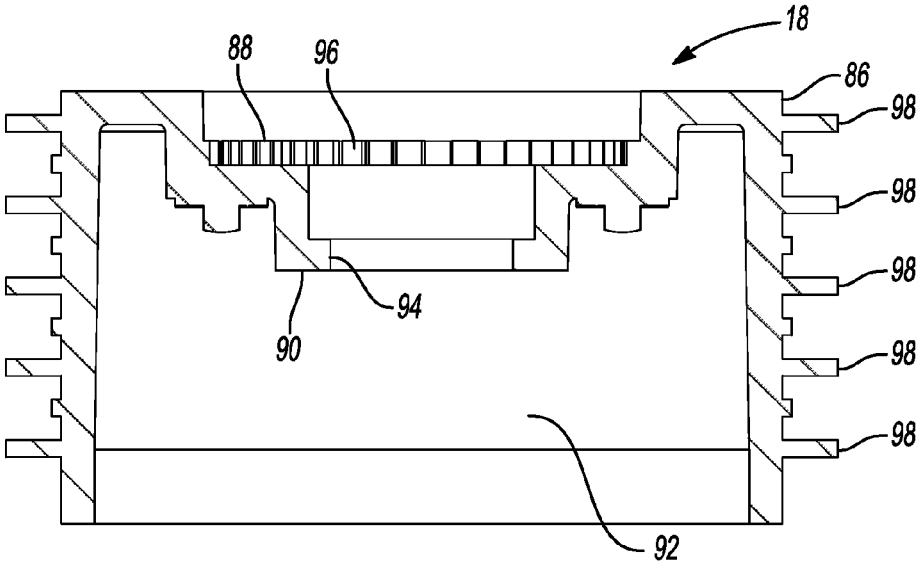
FIG. 15 is a cross-sectional view of the cam device, taking along line 15-15 of FIG. 14.

Referring to FIGS. 13 to 15, the cam device 18 has a hollow construction and includes a hollow cylindrical portion 86, a toothed portion 88, and a shoulder 90. The hollow cylindrical portion 86 has a chamber 92 to allow the boss 30 of the housing 12 to be disposed in the chamber 92. The shoulder 90 is disposed in the upper cylindrical portion 36 of the boss 34 (shown in FIG. 24) and has a central hole 94 open to the chamber 92. The toothed portion 88 defines a plurality of teeth 96 around its inner periphery.

The cylindrical portion 86 defines five tracks 98 on the peripheral surface, which provide data inputs for motor speed and direction. Each track 98 has uneven surfaces for operating the attached switch assembly 16.

Figure 16:
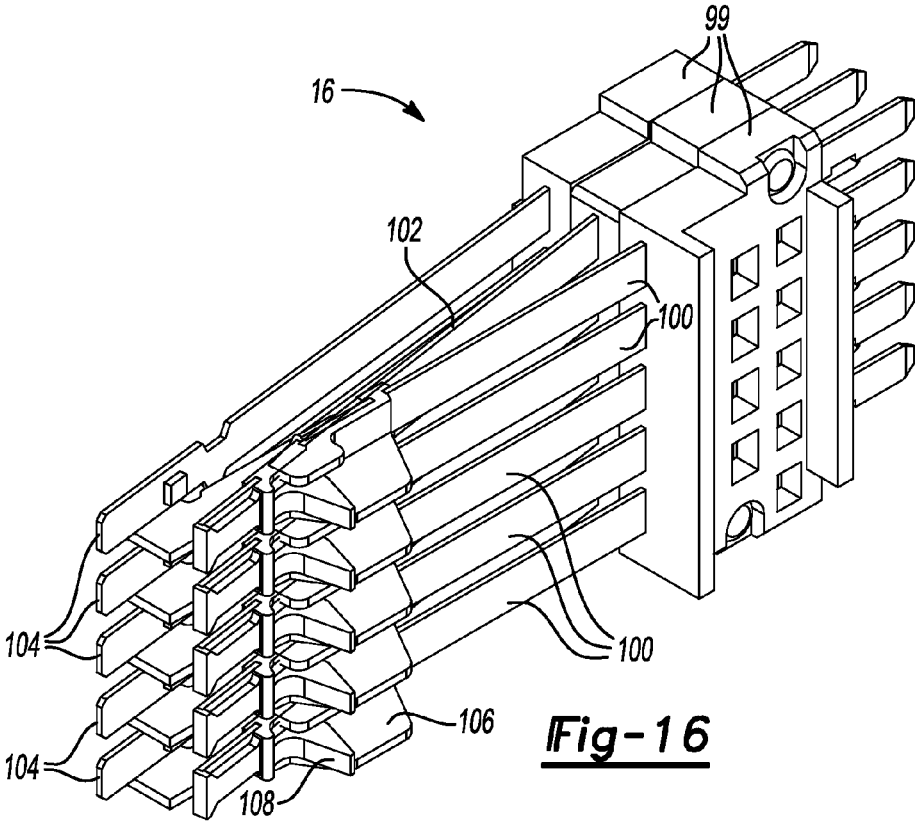
FIG. 16 is a perspective view of a switch assembly.
Figure 17:
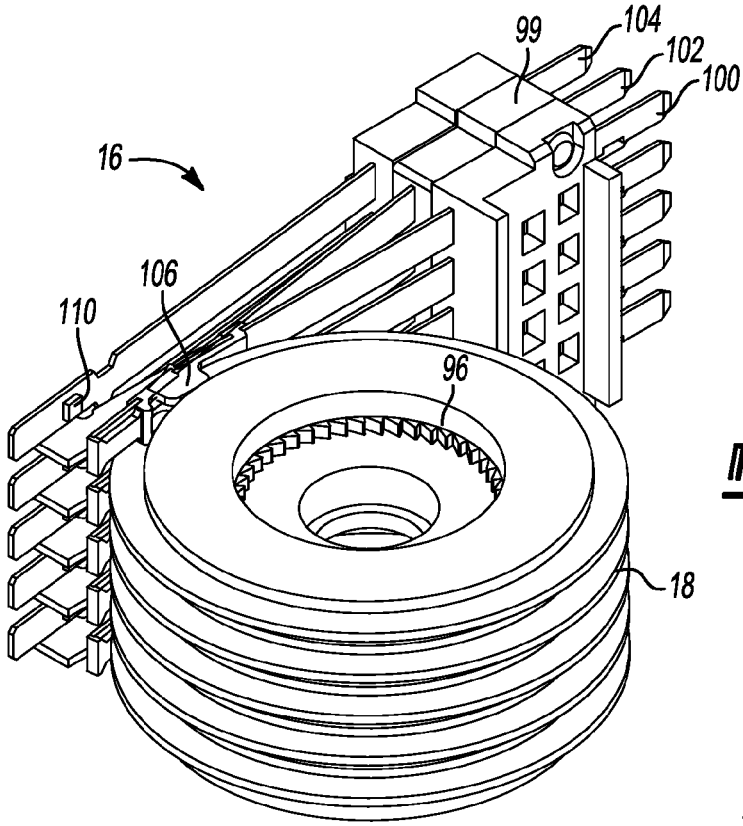
FIG. 17 is a perspective view of the switch assembly and the cam device.

As shown in FIGS. 16 and 17, the switch assembly 16 includes five switch subassemblies secured to individual wafers 99 riveted together. The wafers 99 are received in the seat 48 of the housing 12 for positioning the switch assembly 16 within the housing 12. The five switch subassemblies contact the five tracks 98 of the cam device 18, each switch subassembly including an inner switch arm 100, a central switch arm 102, and an outer switch arm 104. An inner cam follower 106 is attached to the inner switch arm 100 and a central cam follower 108 is attached to the central switch arm 102. The cam follower 106 rides the surface of the cam device 18 and the central cam follower 108 contacts and follows the geometry of the programmed cam surfaces of the cam device 18 and are thus moved in a radial direction of the cam device 18.

Figure 18:
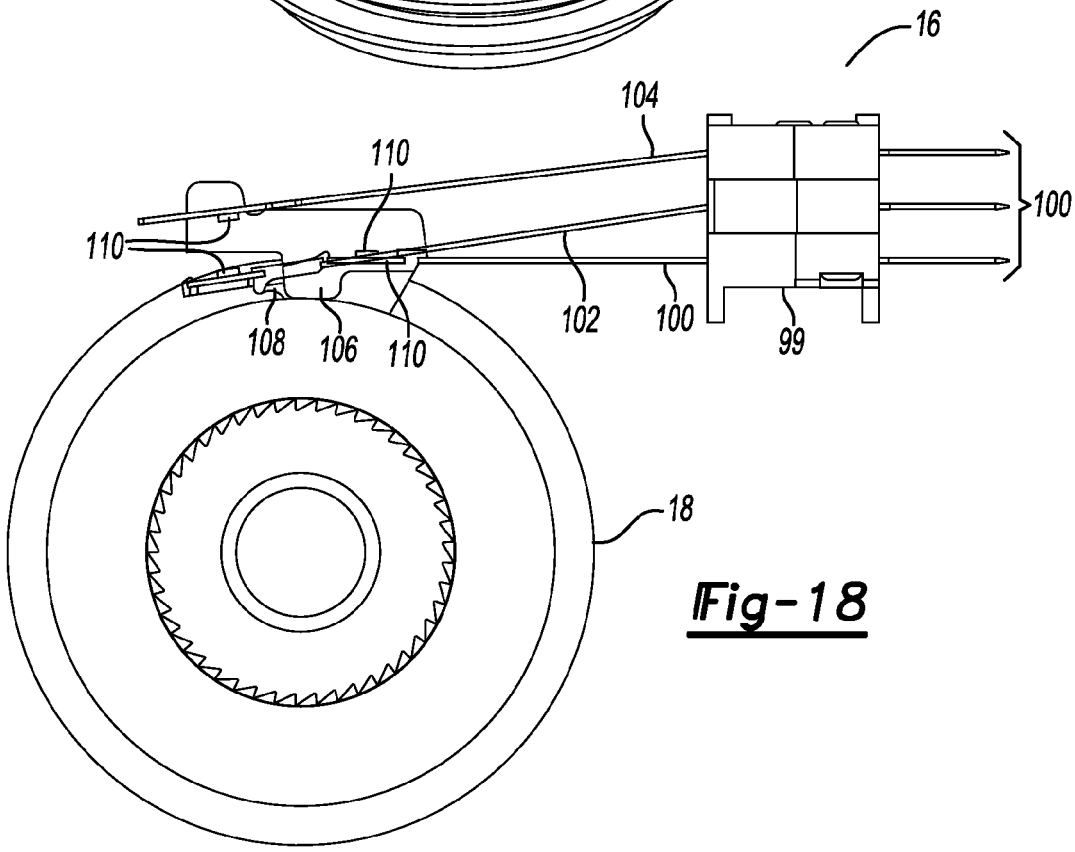
FIG. 18 is a top view of the switch assembly and the cam device.

As clearly shown in FIG. 18, each switch subassembly has four electrical contacts 110. The lifting or lowering of the central switch arms 102 by the cam follower 108 in response to the rotation of the cam device 18 causes the electrical contacts 110 to contact or separate, thereby making or breaking the electrical connections of the electrical circuits associated with the switch arms 100, 102 and 104. These electrical circuits control the various functions of the washing machine.

Figure 19:
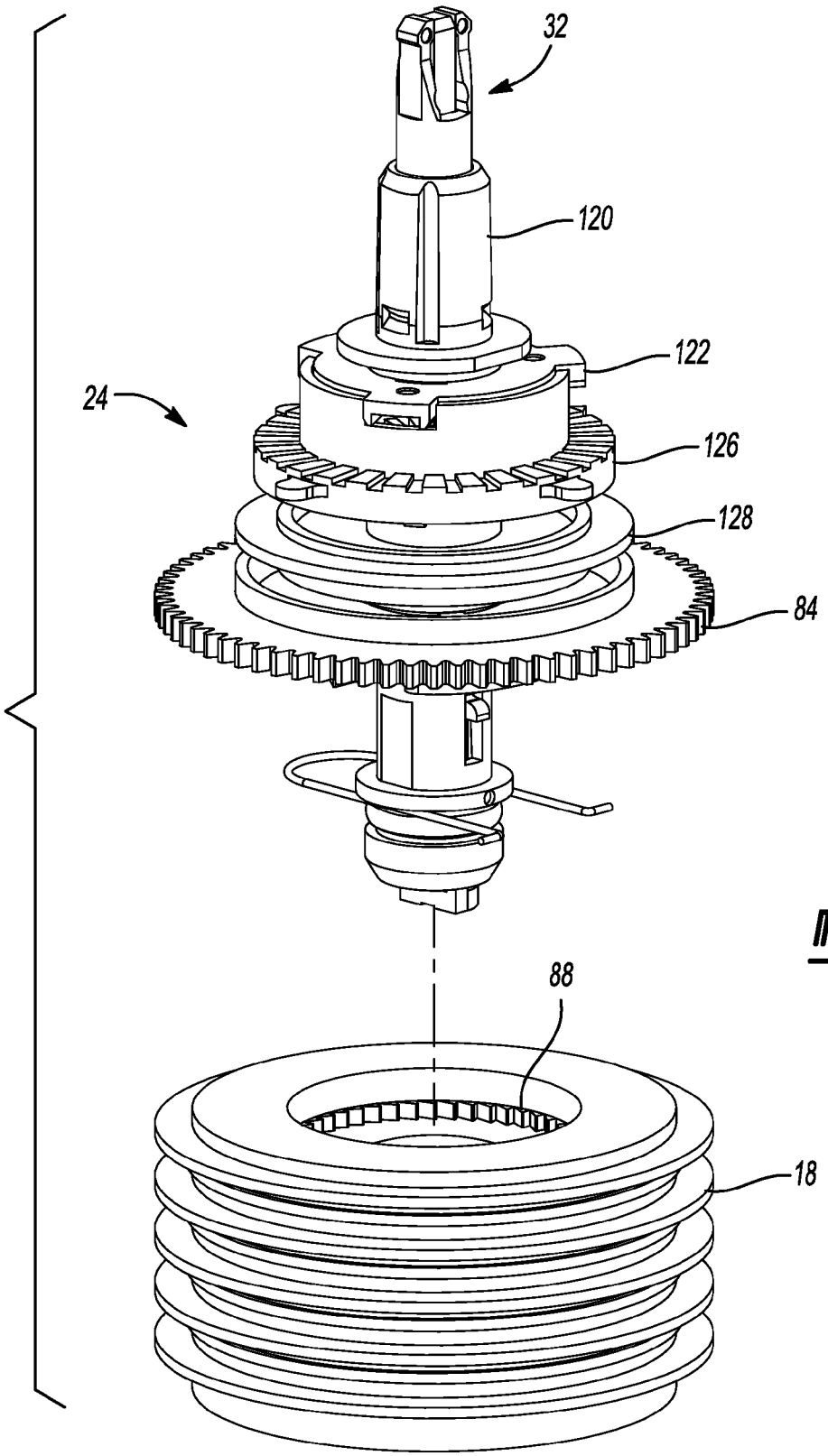
FIG. 19 is a perspective view of the driving mechanism and the cam in their disassembled condition.
Figure 20:
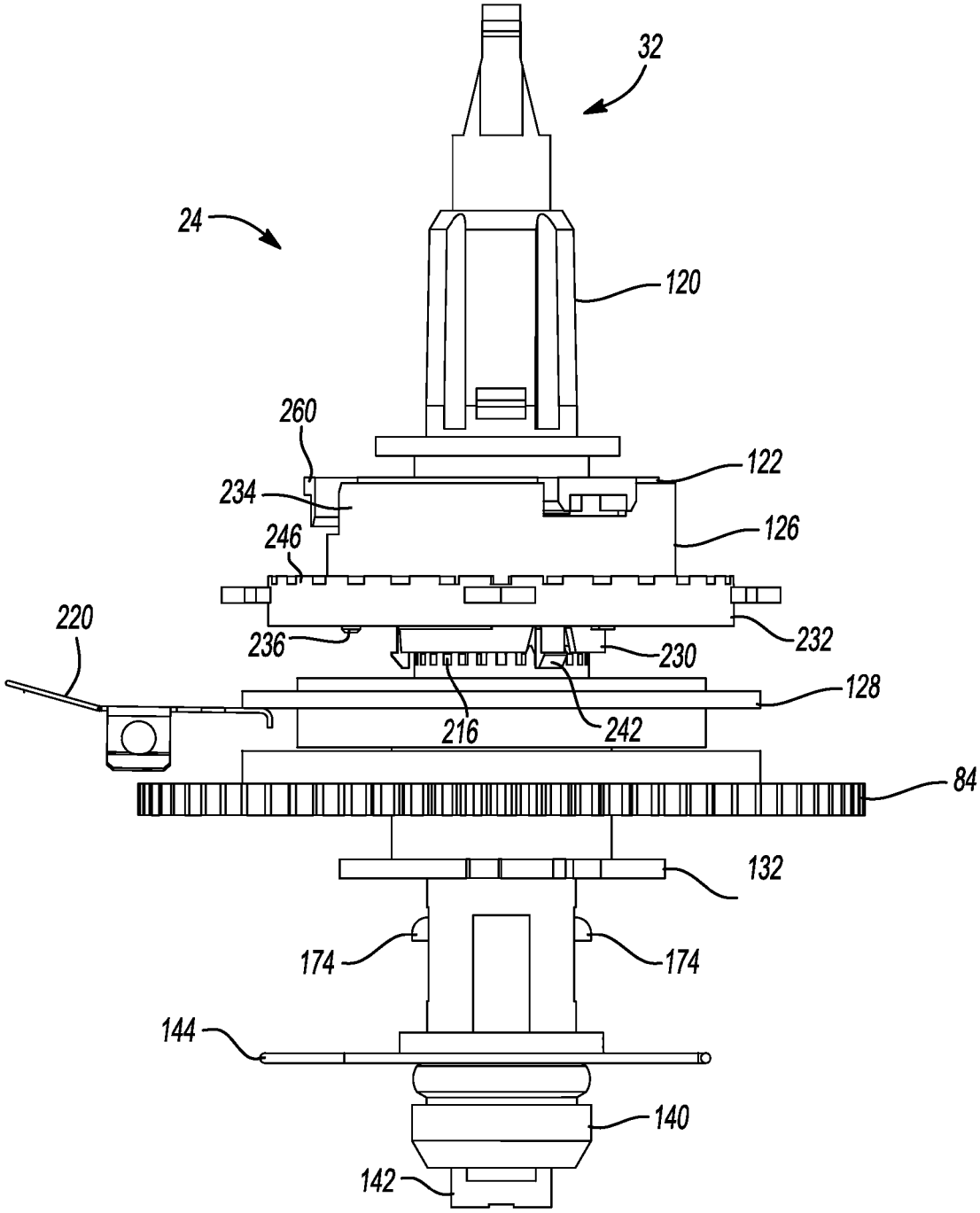
FIG. 20 is a front view of the driving mechanism.
Figure 21:
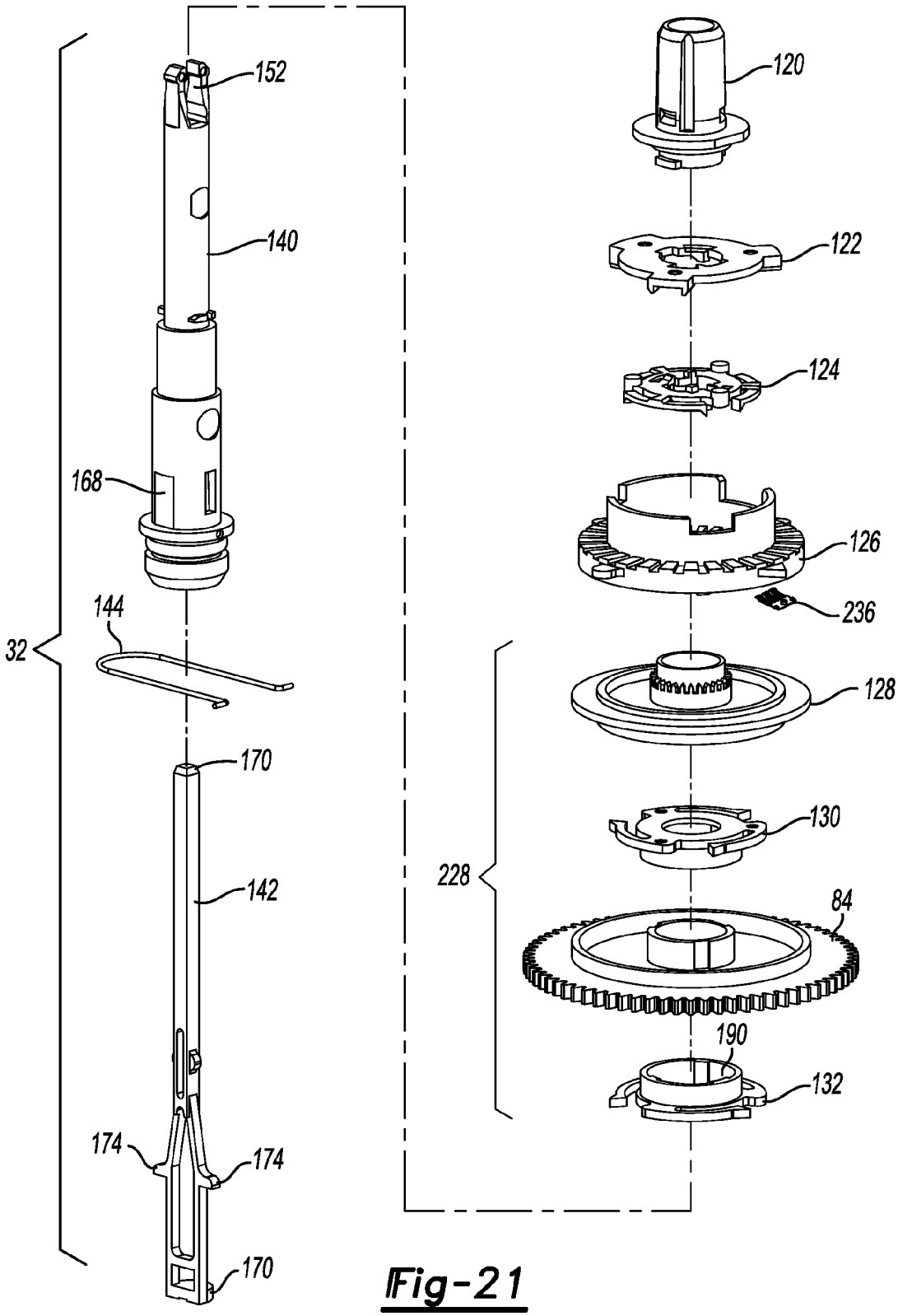
FIG. 21 is an exploded view of the driving mechanism of FIG. 20.

Referring to FIGS. 19 to 21, the driving mechanism 24 is now described in more detail. The driving mechanism 24 includes the shaft assembly 32 for mounting a plurality of driving components including, in the order from top to down, a front hub 120, a rear hub 122, a hub ratchet 124, a wiper drive 126, a rotor drive 128, an upper ratchet 130, the driving wheel 84 and a lower ratchet 132. The driving mechanism 24 is disposed above the cam device 18 with the shaft assembly 32 extending through the toothed portion 88 and the shoulder 90 of the cam device 18.

Figure 22:
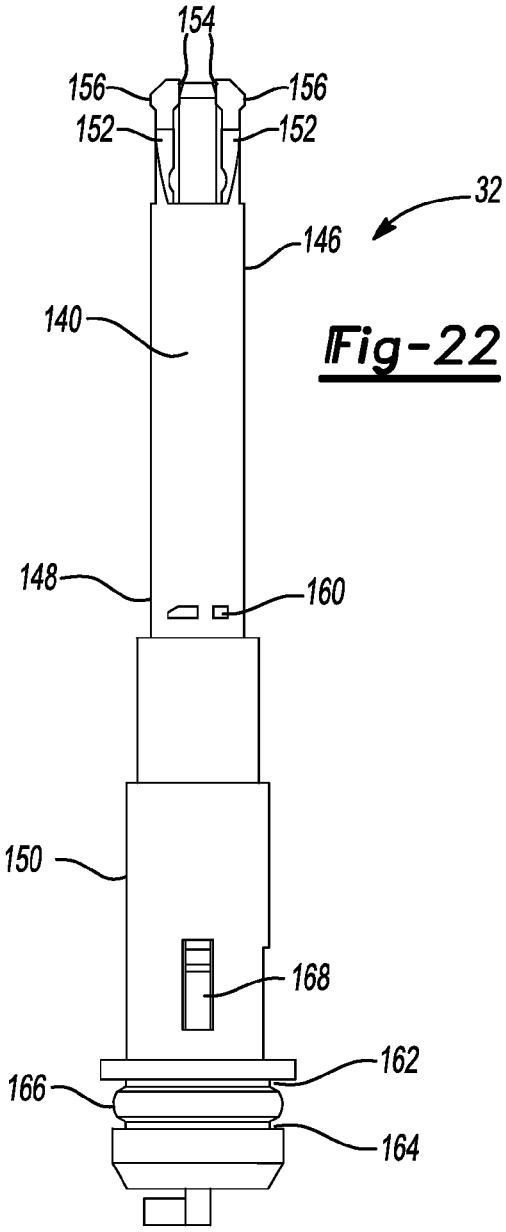
FIG. 22 is a front view of the shaft assembly.
Figure 23:
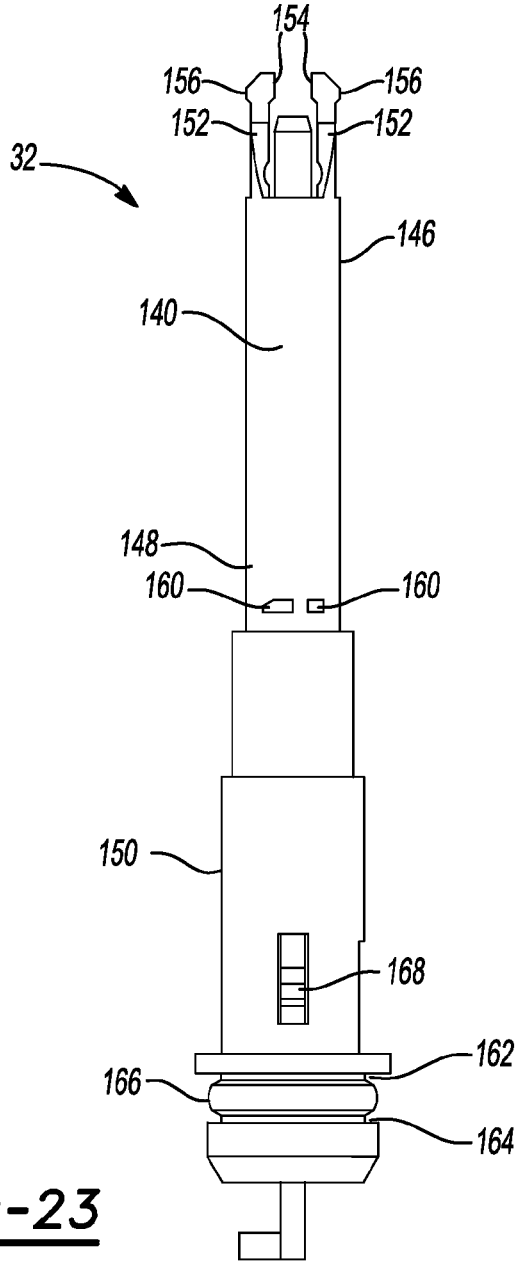
FIG. 23 is a front view of the shaft assembly showing a retaining member in a withdrawn position.

Referring to FIGS. 22 and 23 in conjunction with FIG. 21, the shaft assembly 32 includes a shaft body 140, a retaining member 142 disposed inside the shaft body 140, and a hairpin spring 144 mounted on the shaft body 140. The shaft body 140 has a front section 146 disposed outside the cover 28 for connecting a control knob 147 (shown in FIGS. 25 and 26), a middle section 148 disposed between the housing cover 28 and the support plate 26, and a rear section 150 disposed below the support plate 26. The rear section 150 extends through the hollow space 46 of the boss 34 to outside the housing 12.

The front section 146 of the shaft body 140 includes a locking member in the form of two legs 152. As shown, the legs 152 extend axially along the shaft body 140 and are deflectable in the radial direction of the shaft body 140. The legs 152 each have an inner surface 154 and a projection 156 opposing the inner surface 154. The legs 152 are so configured that the distance between the outermost ends of the projections 156 is slightly larger than the diameter of an insertion hole 158 of the control knob 147 to be inserted. The middle section 148 has a plurality of locking tabs 160.

The rear section 150 of the shaft body 140 defines an upper groove 162, a lower groove 164, and a curved surface 166 therebetween. The hairpin spring 144 is received either in the upper groove 162 or in the lower groove 164, depending on whether the timer 10 is in the operation mode or the selection mode. Two diametrically opposed slots 168 are formed at the rear section 150 along the length of the shaft body 140.

Referring back to FIG. 21, the retaining member 142 is in the form of a rod and disposed inside the shaft body 140. The retaining member 142 includes a front end 170 disposed adjacent to the legs 152 of the shaft body 140 and a rear end 172 extending through the rear section 150 of the shaft body 140. The retaining member 142 has a pair of extensions 174 extending outwardly and diametrically through the slots 168 of the shaft body 140 so that the axial movement of the retaining member 142 within the shaft body 140 is confined.

Figure 24:
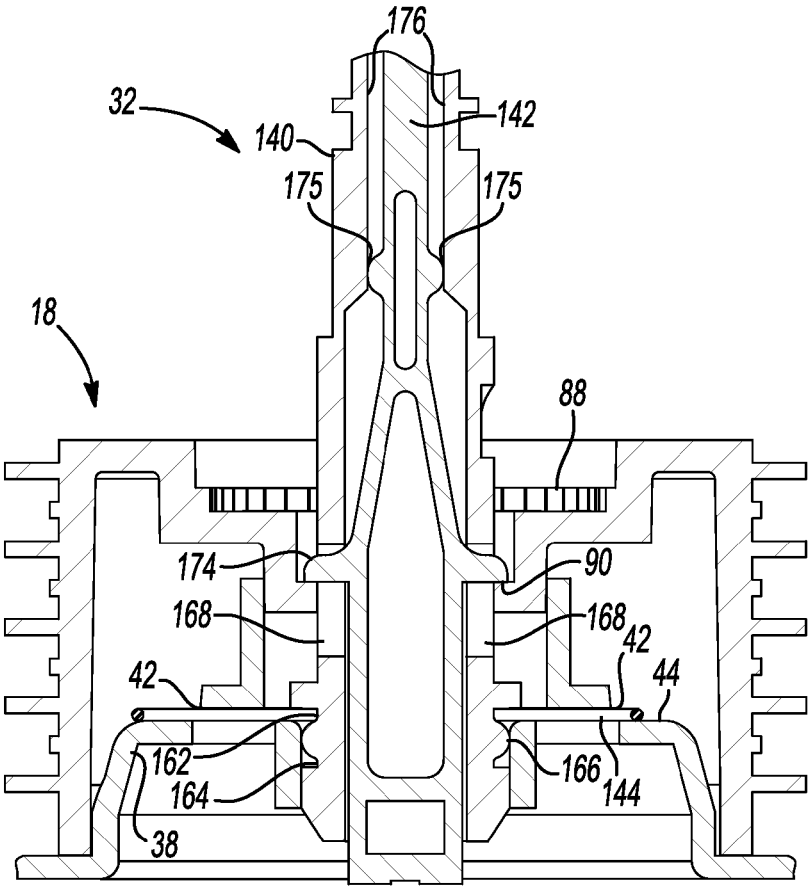
FIG. 24 is cross-sectional view of the shaft assembly and the cam device in a selection mode.

As shown in FIG. 24, the retaining member 142 includes a pair of grip surfaces 175, which are configured to engage a tapered inner wall 176 of the shaft body 140 so that the retaining member 142 frictionally engages the shaft body 140 and is axially moved along with the shaft body 140 when the shaft body 140 is moved.

The shaft assembly 32 is mounted in the cam device 18 through the hairpin spring 144. The hairpin spring 144 is disposed on the top surface 44 of the lower cylindrical portion 38 of the boss 34 and passes through the slots 42 of the boss 34 for engaging the upper groove 162 or the lower groove 164 to hold the shaft assembly 32 in place. The curved surface 166 between the upper groove 162 and the lower groove 164 facilitates a smooth axial movement of the shaft assembly 32.

The extensions 174 of the retaining member 142 extend through the slots 168 of the shaft body 140 and are supported on the shoulder 90 of the cam device 18. When the shaft assembly 32 is in the selection mode as shown in FIG. 23, the retaining member 142 is confined by the upper ends of the slots 168 and the shoulder 90 and cannot be moved. When the shaft assembly 32 is in the operation mode, the shaft body 140 and the retaining member 142 are moved together axially upward. A part of the slots 168 is thus located above the shoulder 90 so that the retaining member 142 can be pulled downwardly relative to the shaft body 140 in a range defined by the upper ends of the slots 168 and the shoulder 90.

Figure 25:
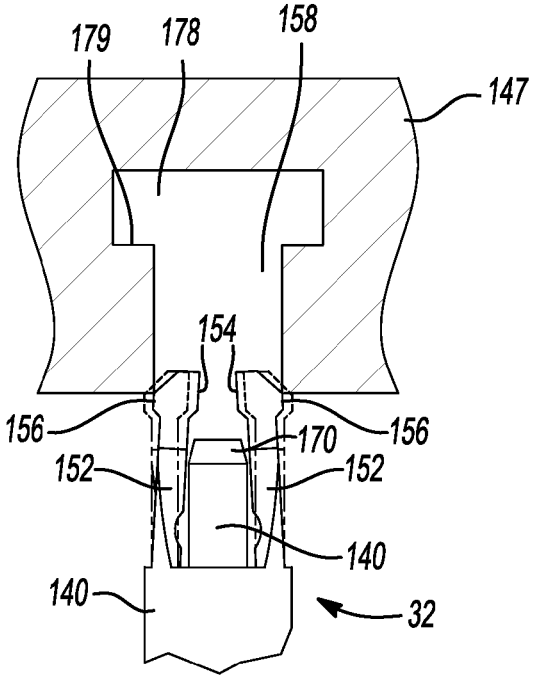
FIG. 25 is a schematic view showing the beginning of insertion of the shaft assembly into a control knob.
Figure 26:
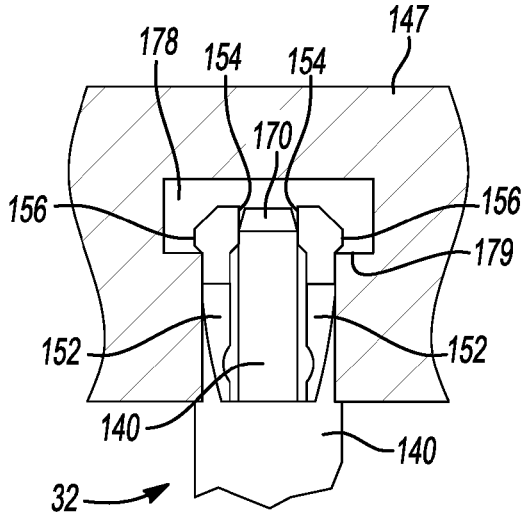
FIG. 26 is a schematic view showing the completion of insertion of the shaft assembly into the control knob.

As shown in FIGS. 25 and 26, the control knob 147 defines an insertion hole 158 and a receiving space 178. The receiving space 178 has a diameter larger than that of the insertion hole 158 to define a shoulder 179 therebetween. To secure the control knob 147 to the shaft assembly 32, the front end 170 of the retaining member 142 is withdrawn from the space between the inner surfaces 154 of the legs 152. As previously described, the legs 152 are so configured that the distance between the outermost ends of the projections 156 of the legs 152 is slightly larger than the diameter of the insertion hole 158 of the control knob 147. When the legs 152 are being inserted, the legs 152 are deflected toward each other. When the insertion is completed, the legs 152 return to their initial undeflected condition and the projections 156 abuts against the shoulder 179, which prevents the legs 152 from being removed.

To maintain the legs 152 in their initial, undeflected position and abutting against the shoulder 179, the retaining member 142 is moved axially upward to make the front end 170 disposed in the space between the inner surfaces 154 of the legs 152 and contacting the inner surfaces 154. As a result, there is not room for the legs 152 to deflect toward each other and thus the projections 156 are maintained against the shoulder 179.

Referring back to FIG. 24, as previously described, when the shaft assembly 32 is assembled to the cam device 18 and the housing 12, the retaining member 142 cannot be moved relative to the shaft body 140 when the timer 10 is in the selection mode. To remove the control knob 147, the shaft assembly 32 is first pulled up to the operation mode, followed by pulling the retaining member 142 downward to withdraw the front end 170 from the space. Therefore, the legs 152 can be deflected toward each other and withdrawn from the insertion hole 158.

Alternatively, while not shown in the drawings, the legs 152 can be configured to be easily insertable into the insertion hole 158 of the control knob 147 without being deflected. After the projections 156 are disposed in the receiving space 178, the front end 170 of the retaining member 142 is moved to the space between the legs 152 to deflect the legs 152 outwardly to cause the projections 156 to abut against the shoulder 179, thereby locking the control knob 147 to the legs 152. By withdrawing the front end 170 of the retaining member 142 from the space between the legs 152, the legs 152 are returned to their initial undeflected position and the projections 156 are moved away from the shoulder 179 so that the control knob 147 can be easily removed.

The advantage of the above arrangement is that the control knob 147 cannot be removed by a user from the operating side of the control knob 147 without pulling the retaining member 142 downward from the rear end 172. Because the shaft assembly 32 has a self-locking or self-retaining capability once the control knob 147 is assembled to the shaft assembly 32, the control knob 147 is less likely to be removed from the shaft assembly 32.

Figure 27:
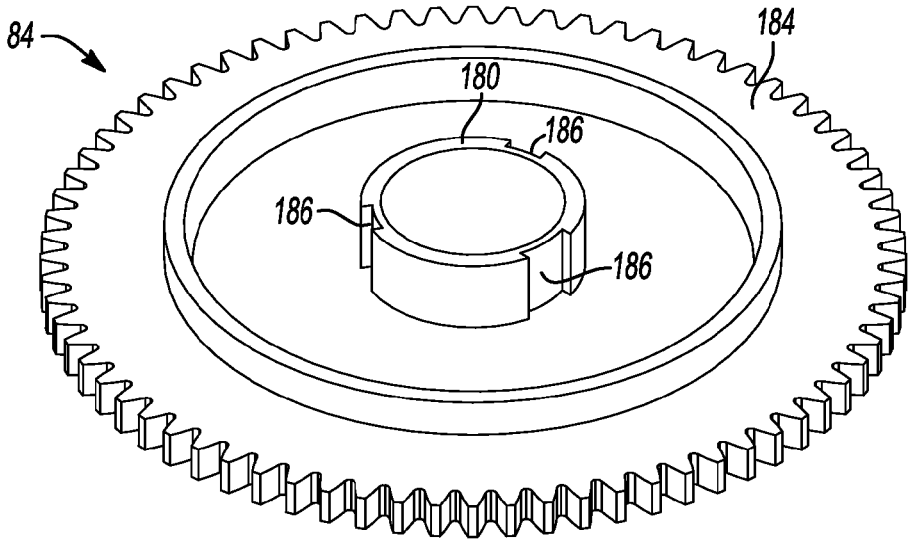
FIG. 27 is a top perspective view of the driving wheel of the driving mechanism.
Figure 28:
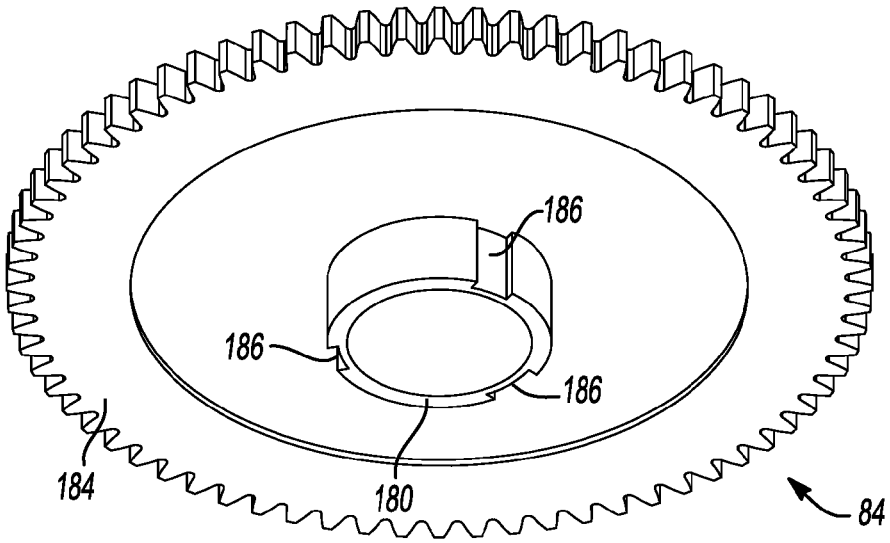
FIG. 28 is a bottom perspective view of the driving wheel of FIG. 27.

Referring to FIGS. 27 and 28 in conjunction with FIG. 20, as previously described, the driving wheel 84 engages the gear train 22 and is driven by the motor 20 through the gear train 22 in a direction opposite to the direction of the motor 20. The driving wheel 84 then drives the various driving components mounted on the shaft assembly 32, and the cam device 18 disposed below the driving wheel 84.

The driving wheel 84 has an upper collar 180, a lower collar 182 and a gear portion 184 therebetween. The upper collar 180 and the lower collar 182 each have three keyways 186 for securing the upper ratchet 130 and the lower ratchet 132, respectively. The gear portion 184 meshes with the pinion 82 of the gear train 22 (shown in FIG. 12).

Figure 29:
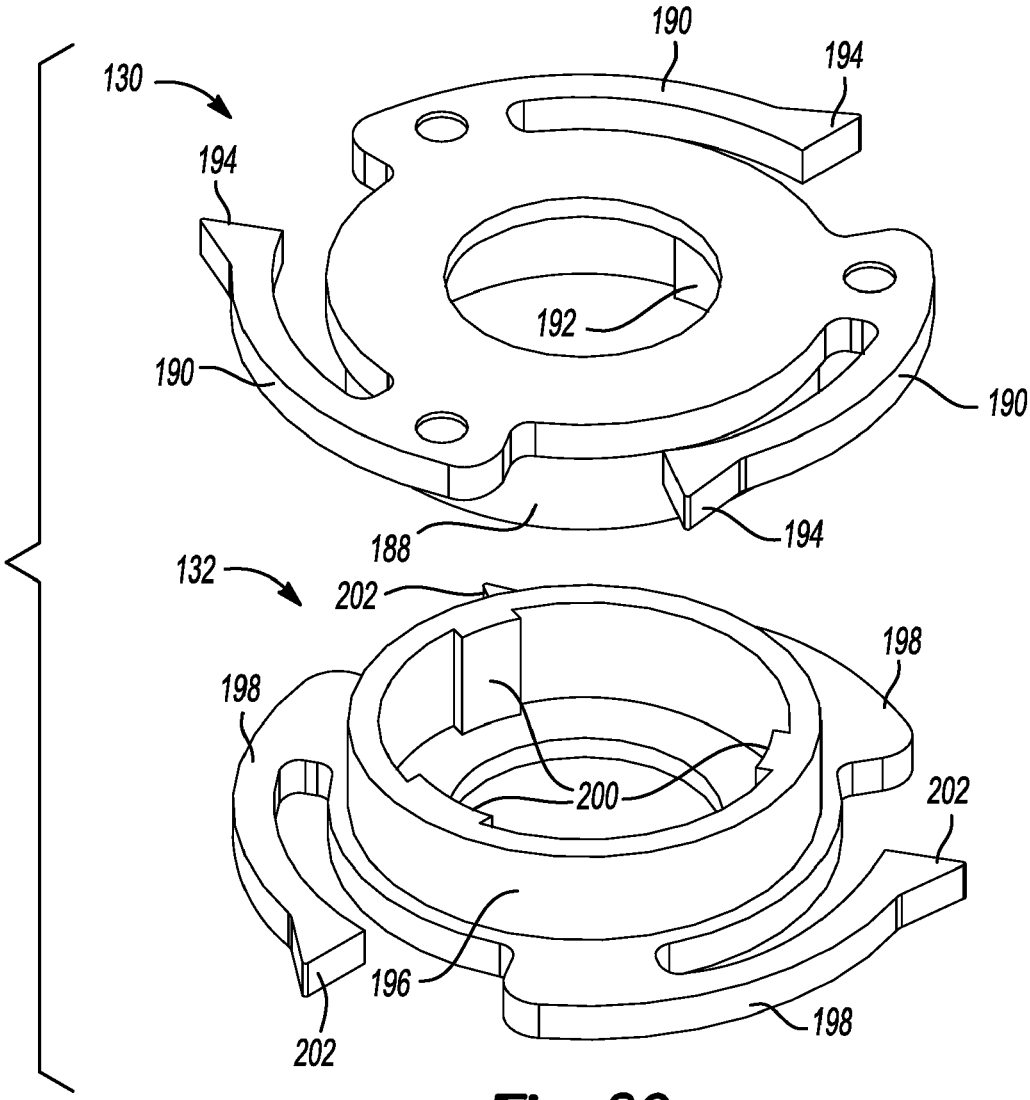
FIG. 29 is a perspective view of an upper ratchet and a lower ratchet.

Referring to FIG. 29, the upper ratchet 130 and the lower ratchet 132 have a similar construction and are mounted to the front side and the rear side of the driving wheel 84. The upper ratchet 130 includes a ratchet collar 188, around which three ratcheting arms 190 are disposed and extend in a circumferential direction. The ratchet collar 188 of the upper ratchet 130 has three keys 192 (only one is shown in FIG. 29) for engaging the three keyways 186 on the upper collar 180 of the driving wheel 84. The ratcheting arms 190 each have a detent 194.

Similarly, the lower ratchet 132 has a ratchet collar 196, around which three ratcheting arms 198 are disposed and extend in a circumferential direction. The ratchet collar 196 of the lower ratchet 132 has three keys 200 for engaging the keyways 186 on the lower collar 182 of the driving wheel 84. The ratcheting arms 198 each have a detent 202 for engaging the toothed portion 88 of the cam device 18. As shown, the detents 202 of the lower ratchet 132 and the detents 194 of the upper ratchet 130 are oppositely disposed.

Figure 30:
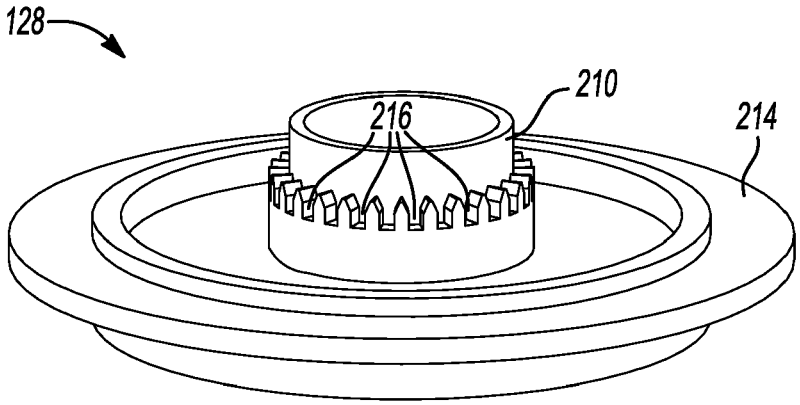
FIG. 30 is a perspective view of a rotor drive.
Figure 31:
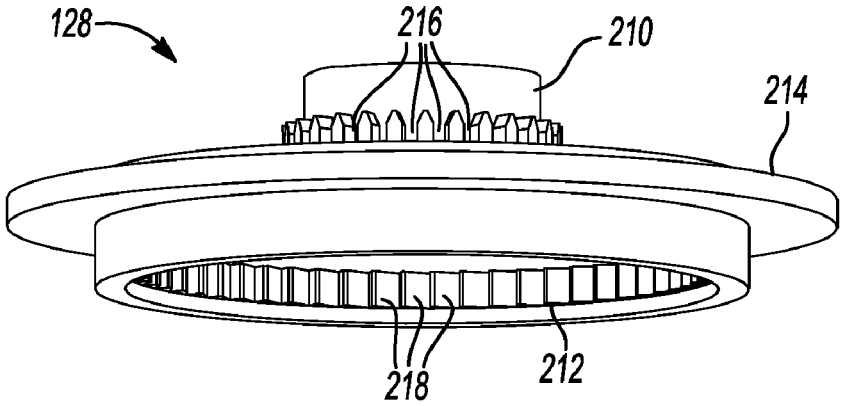
FIG. 31 is another perspective view of the rotor drive of FIG. 30.

Referring to FIGS. 30 and 31 in conjunction with FIG. 19, the rotor drive 128 is disposed above of the driving wheel 84 and includes a crown portion 210, a toothed ring 212, and a peripheral flange 214 therebetween. The crown portion 210 defines a plurality of side grooves 216. The toothed ring 212 includes a plurality of teeth 218 for engaging the detents 194 of the upper ratchet 130. The peripheral flange 214 is used to press a switch arm 220 (shown in FIG. 20) disposed immediately below the peripheral flange 214 and pivotably mounted on the hinge 58 of the support plate 26 (shown in FIG. 8). When the shaft assembly 32 is pushed down to the selection mode, the rotor drive 128 is moved to press the switch arm 220 to signal the need to interrupt power to the motor 20.

Figure 32:
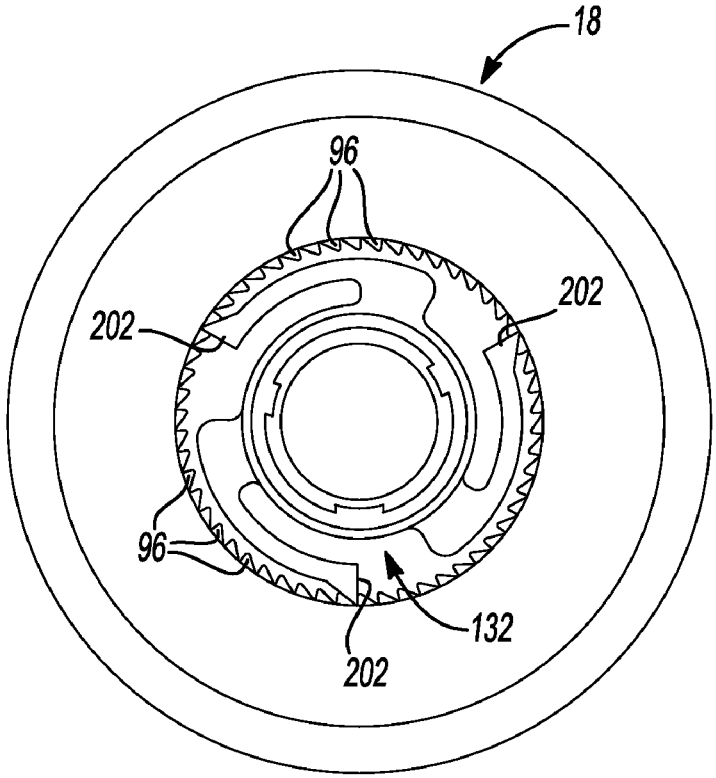
FIG. 32 is a top view of the lower ratchet and the cam device.
Figure 33:
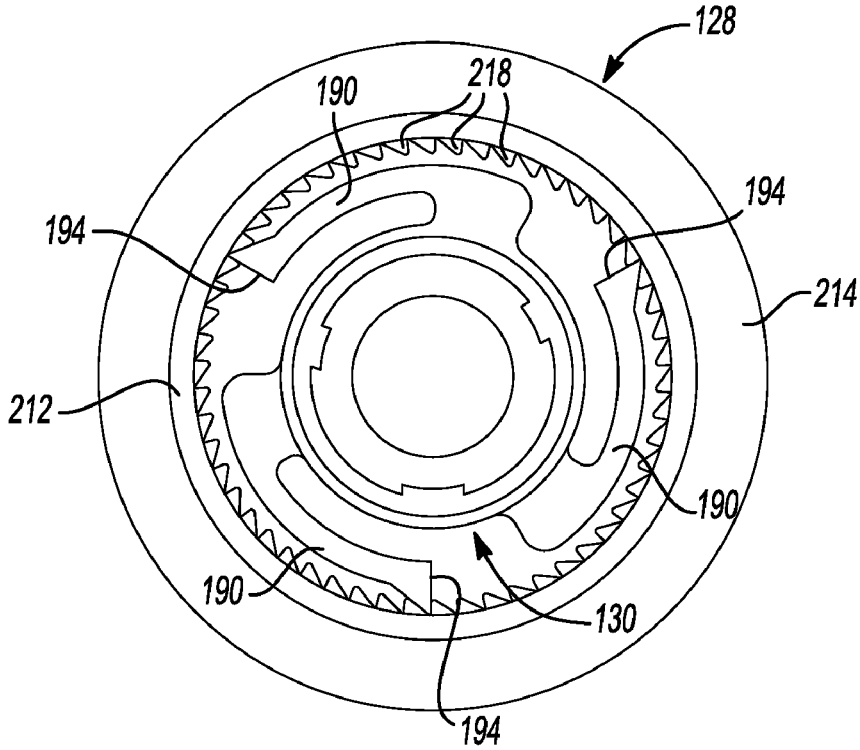
FIG. 33 is a bottom view of the upper ratchet and the rotor drive.

Referring to FIGS. 32 and 33, the lower ratchet 132 (top view) is disposed within the toothed portion 88 of the cam device 18 as shown in FIG. 32, while the upper ratchet 130 (bottom view) is disposed in the toothed ring 212 of the rotor drive 128 as shown in FIG. 33. When the driving wheel 84 rotates, the upper ratchet 130 and the lower ratchet 132 are driven by the driving wheel 84 in the same direction, which in turn drive an adjacent component. As previously described, the detents 194 of the upper ratchet 130 and the detents 202 of the lower ratchet 132 are oppositely disposed. Therefore, only one of the adjacent components engaging the upper ratchet 130 and the lower ratchet 132 is driven when the driving wheel 84 rotates in one direction. In this case, the adjacent component engaging the upper ratchet 130 is the rotor drive 128 and the adjacent component engaging the lower ratchet 132 is the cam device 18. Only one of the rotor drive 128 and the cam device 18 is driven at a time.

More specifically, as shown in FIG. 32, when the driving wheel 84 rotates CCW, the detents 202 of the lower ratchet 132 presses the teeth 96 of the cam device 18, thereby driving the cam device 18 CCW. At the same time, as shown in FIG. 33, the detents 194 of the upper ratchet 130 slips relative to the teeth 218 of the rotor drive 128 and thus the rotor drive 128 is not driven. (FIG. 33 is a bottom view of the upper ratchet 130 and the rotor drive 128 and thus the upper ratchet 130 is shown in FIG. 33 to rotate CW, when the lower ratchet 132 is shown in FIG. 32 to rotate CCW.)

Similarly, when the driving wheel 84 rotates CW, the upper ratchet 130 presses the teeth 218 of the toothed ring 212 of the rotor drive 128 and drives the rotor drive 128 CW. However, the lower ratchet 132 slips relative to the toothed portion 88 of the cam device 18 and does not drive the cam device 18. In the described manner, the driving wheel 84, the rotor drive 128, the upper ratchet 130, and the lower ratchet 132 may collectively act as a clutch 228. The clutch 228 is shown, for example, in FIG. 21.

Figure 34:
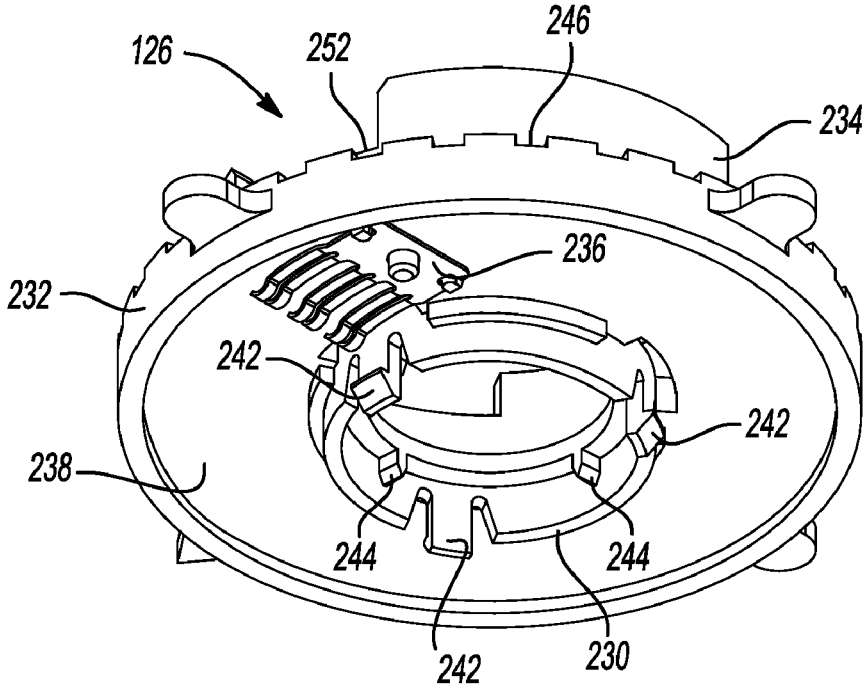
FIG. 34 is a perspective view of the wiper drive.
Figure 35:
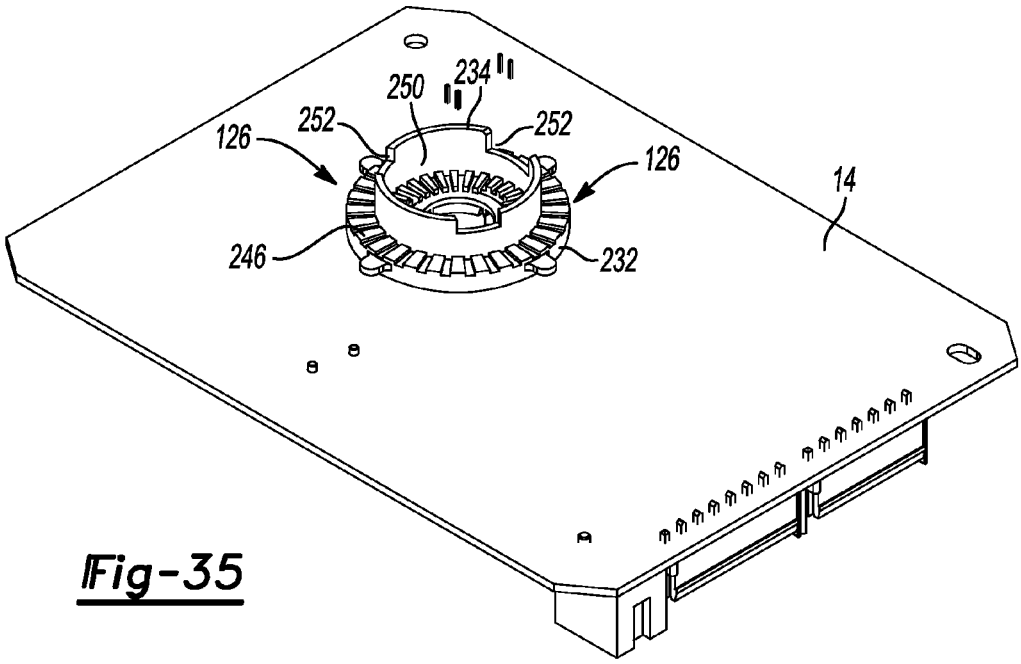
FIG. 35 is a top perspective view of the wiper drive and the printed circuit board.
Figure 36:
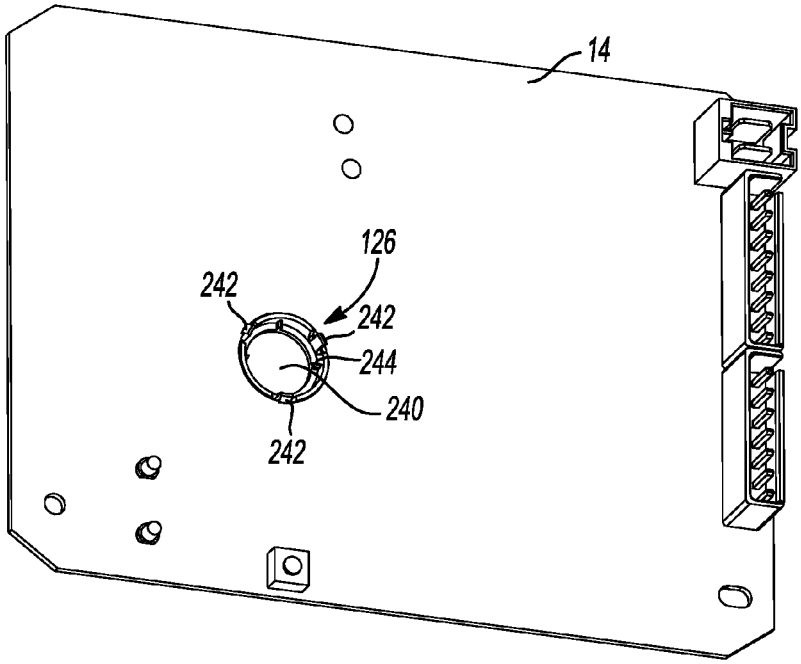
FIG. 36 is a bottom perspective view of the wiper drive and the printed circuit board of FIG. 35.
Figure 37:
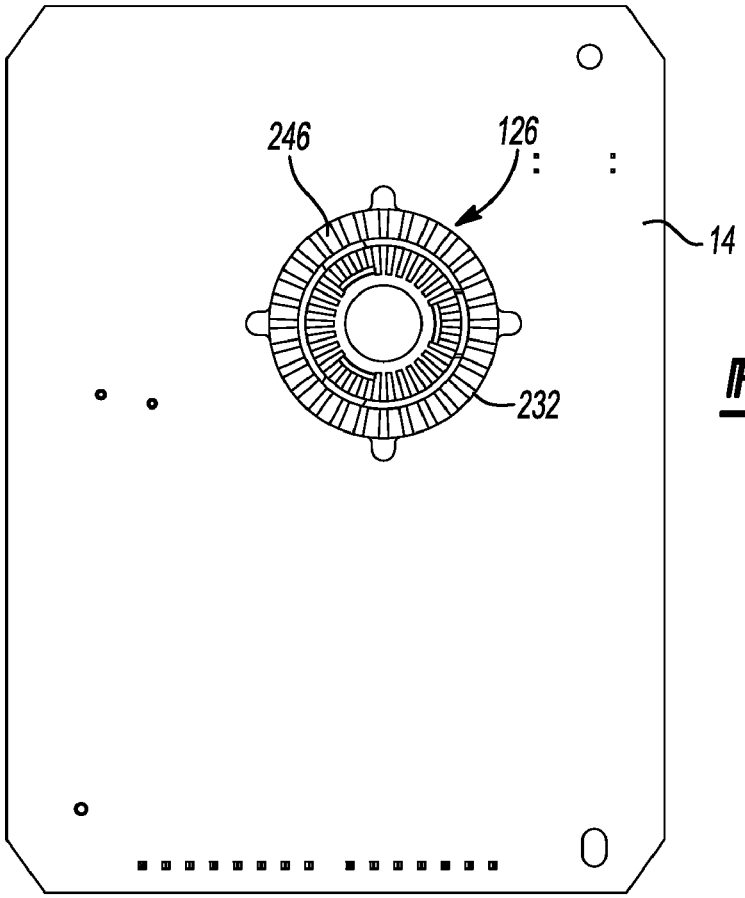
FIG. 37 is a top view of the wiper drive and the printed circuit board.

Referring to FIG. 34 to 37 in conjunction with FIG. 20, the wiper drive 126 is mounted to the printed circuit board 14. The wiper drive 126 includes a wiper drive hub 230, an index plate 232, a cylindrical wall 234 extending upwardly from the index plate 232, and a conductive wiper 236 secured to a bottom surface 238 of the index plate 232. The wiper drive hub 230 is configured to fit into a hole 240 of the printed circuit board 14 and has three locking tabs 242 for engaging the side wall of the hole 240 of the printed circuit board 14 so as to rotatably mount the wiper drive 126 to the printed circuit board 14. Four protrusions 244 (only one is shown in FIG. 34) extend downwardly from an inner surface of the wiper drive hub 230 for engaging the side grooves 216 (shown in FIG. 31) of the crown portion 210 of the rotor drive 128. The index plate 232 has a grooved surface 246, which defines twenty eight grooves (positions) corresponding to various appliance functions or cycles.

Figure 38:
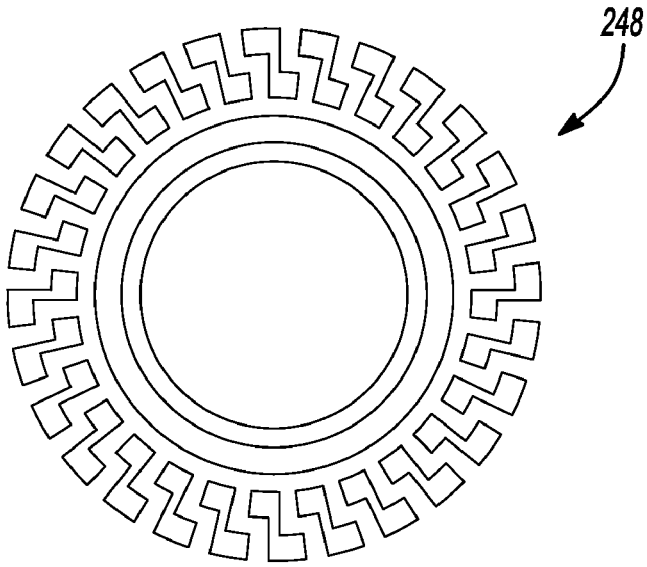
FIG. 38 is a view showing an electrical circuit pattern on the printed circuit board.

The conductive wiper 236 is disposed between the index plate 232 and the printed circuit board 14 for contacting an adjacent electrical circuit pattern 248 (shown in FIG. 4). FIG. 38 shows the details of the electrical circuit pattern 248. As the wiper drive 126 rotates, the conductive wiper 236 is driven to contact the electrical circuit pattern 248 so that the angular position of the wiper drive 126 is communicated to the microprocessor. The conductive wiper 236 and the electrical circuit pattern 248 cooperate during rotation of the wiper drive 126 to provide position signals to the microprocessor when the timer 10 is in the selection mode.

The cylindrical wall 234 defines a receiving space 250 for receiving the hub ratchet 124 therein, and three cutout portions 252 for engaging the rear hub 122.

Figure 39:
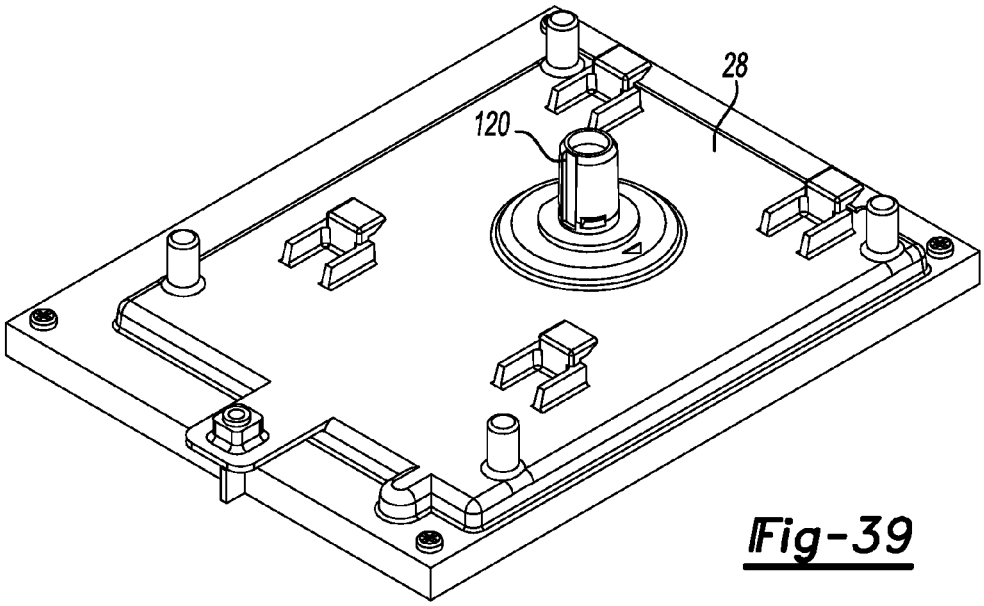
FIG. 39 is a top perspective view of the front hub and the cover.
Figure 40:
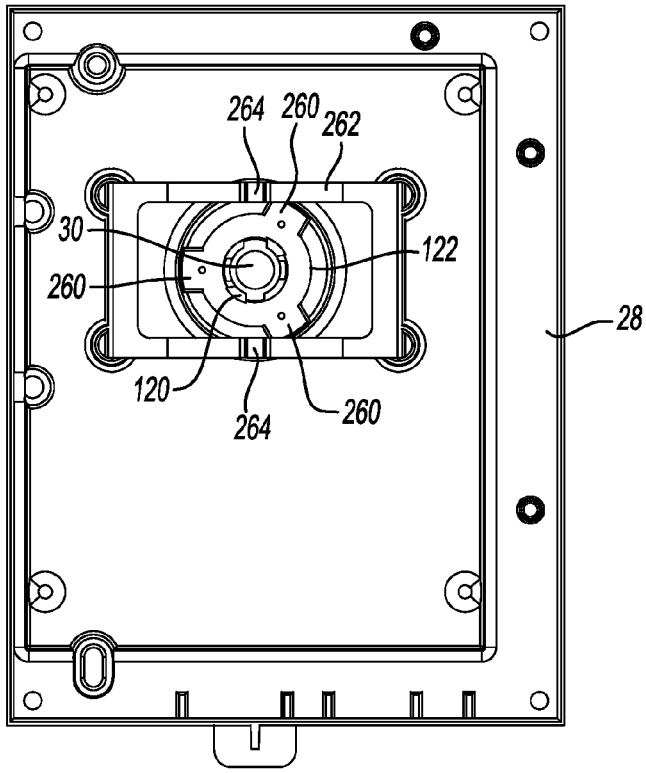
FIG. 40 is a bottom view of the cover, the front hub, and the rear hub and the detent spring in their assembled condition.
Figure 41:
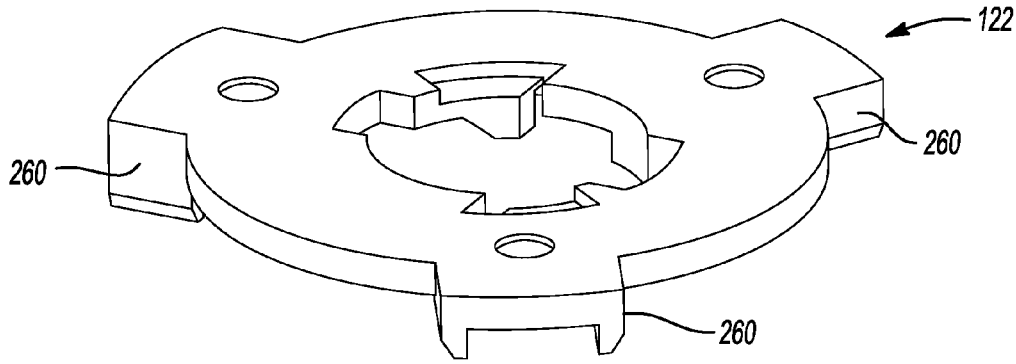
FIG. 41 is a perspective view of the rear hub.

Referring to FIGS. 39 to 41, the front hub 120 and the rear hub 122 are rotatably mounted to the front side and the rear side of the housing cover 28, respectively, and pass through the hole 30 of the cover 28 to clamp the cover 28 therebetween. The front hub 120 and the rear hub 122 engage each other so that they are rotated as a unit. The rear hub 122 has three lugs 260 extending downwardly for engaging the cutout portions 252 of the wiper drive 126 (shown in FIG. 20) so that the rotation of the front hub 120 and the rear hub 122 drives the wiper drive 126 and vice versa. The front hub 120 and the rear hub 122 are mounted around the shaft assembly 32. A display device 8 such as a dial skirt (shown in FIG. 1) is mounted around the front hub 120 for indicating the operational status of the appliance. When the front hub 120, the rear hub 122 and the wiper drive 126 rotate, the dial skirt also rotates.

Figure 42:
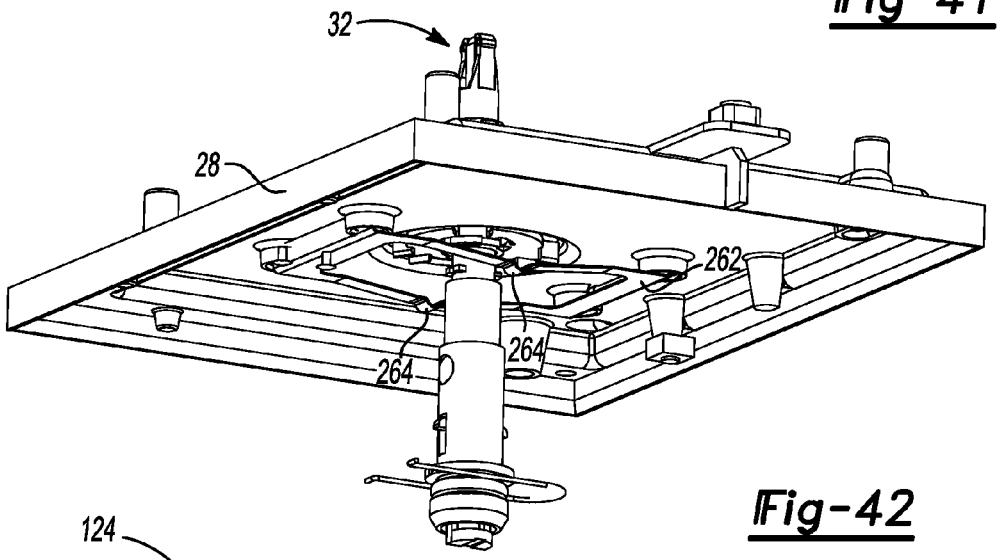
FIG. 42 is a perspective view of the shaft assembly, the cover, the detent spring, the front hub and the rear hub.

As clearly shown in FIG. 42, a detent spring 262 is mounted to the rear side of the cover 28 and has a pair of projections 264 adapted to engage the grooved surface 246 of the index plate 232 of the wiper drive 126 (shown in FIG. 34) as the wiper drive 126 rotates. The detent spring 262 provides a tactile feedback to the user when the user rotates the control knob 147, which in turns drives the wiper drive 126.

Figure 43:
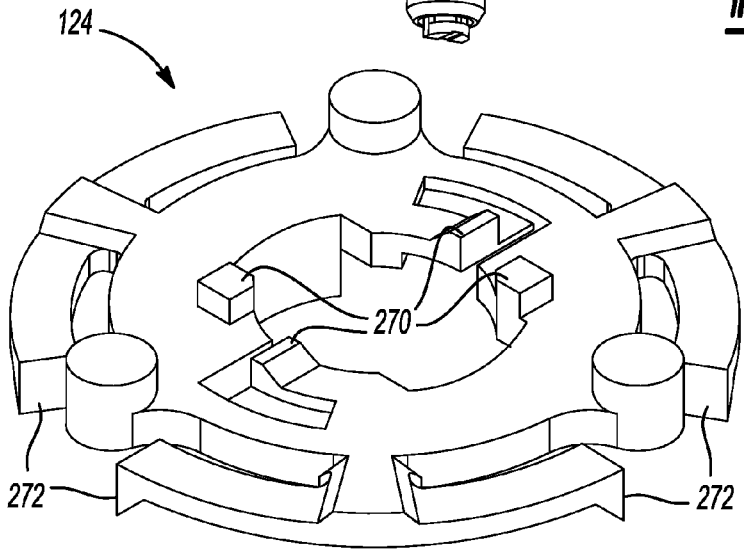
FIG. 43 is a perspective view of a hub ratchet.

Referring to FIG. 43, the hub ratchet 124 is secured to the shaft body 140 to be moved with the shaft body 140 as a unit. The hub ratchet 124 is disposed within the receiving space 250 (shown in FIG. 35) of the wiper drive 126 adjacent to the grooved surface 246. The hub ratchet 124 includes locking tabs 270 for engaging the locking tabs 160 of the shaft body 140 (shown in FIG. 22) and tips 272 extending downwardly for engaging the grooved surface 246 of the wiper drive 126.

Figure 44:
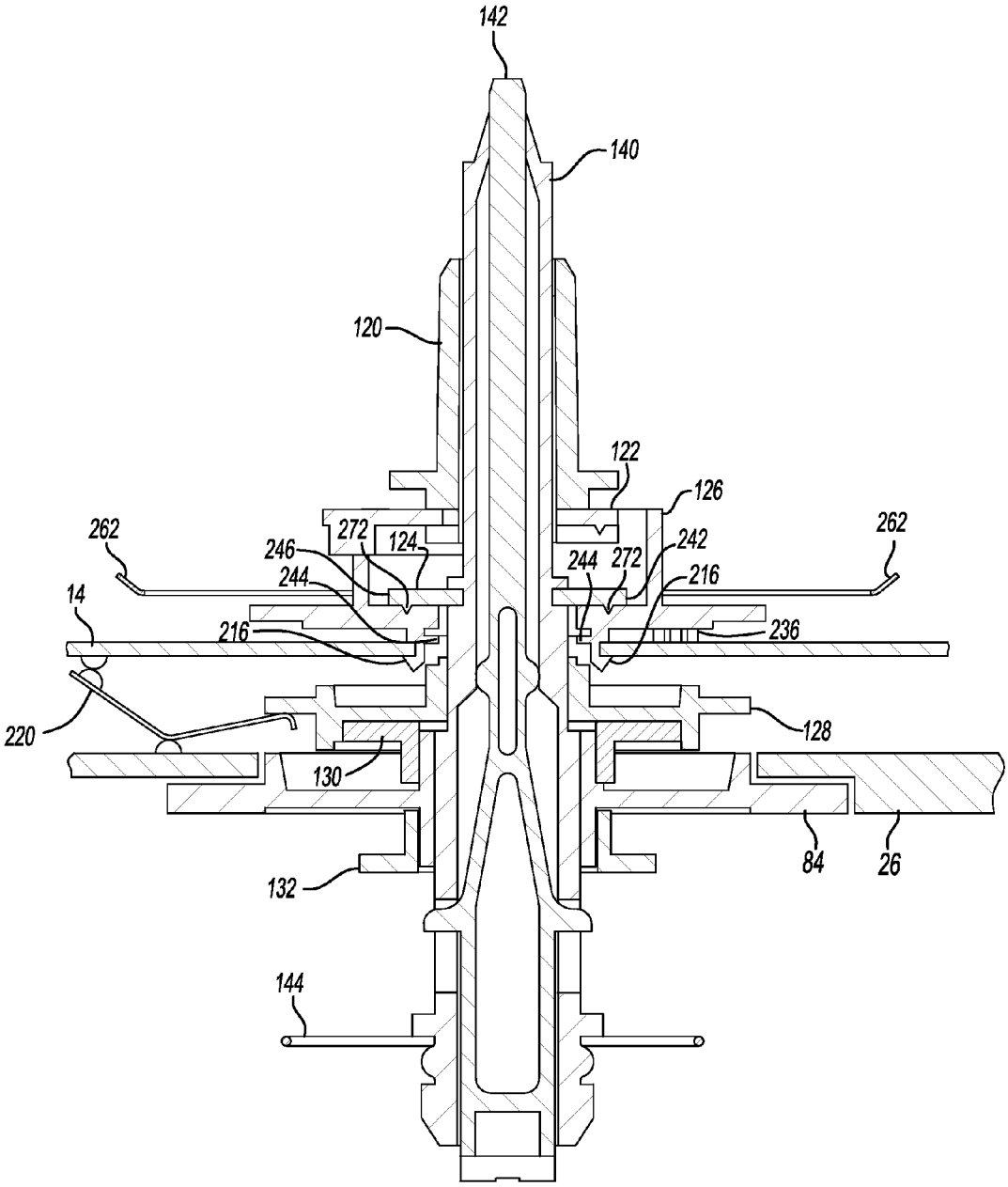
FIG. 44 is a cross-sectional view of the driving mechanism in a selection mode.
Figure 45:
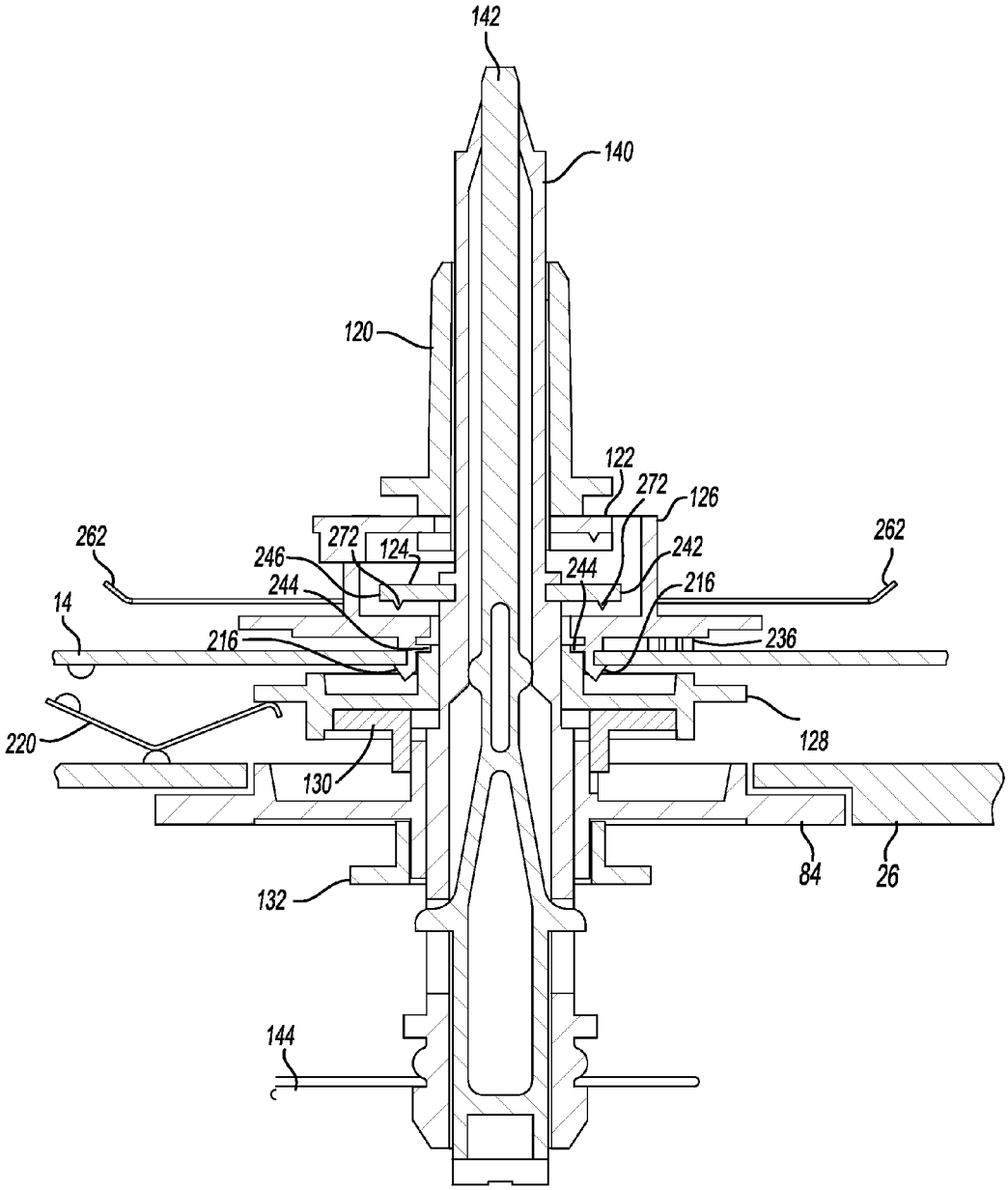
FIG. 45 is a cross-sectional view of the driving mechanism in an operation mode.
Figure 46:
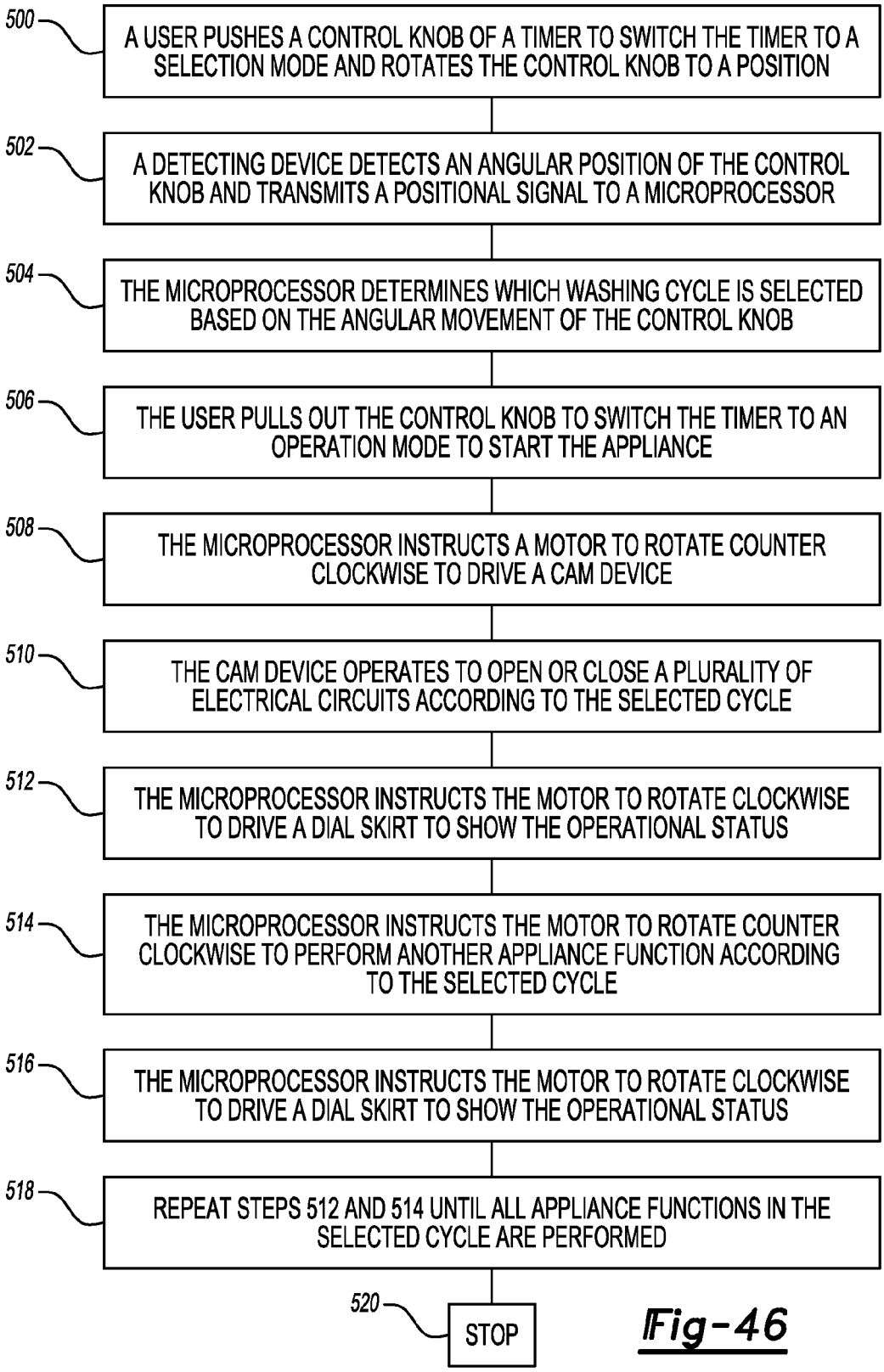
FIG. 46 is a schematic flow diagram showing the operation of the timer in accordance with the present disclosure.

Referring to FIGS. 44 to 46, the operation of the timer 10 is now described in more detail. To operate the appliance, a user first pushes the control knob 147 of the timer 10 to move the shaft assembly 32 down, causing the hairpin spring 144 to engage the upper groove 162 as shown in FIG. 44. The hub ratchet 124 is also moved axially to engage the grooved surface 246 of the wiper drive 126 through the tips 272. At the same time, rotor drive 128 is moved by the hub ratchet 124 on the shaft assembly 32 away from the wiper drive 126 so that the protrusions 244 disengage from the side grooves 216 of the rotor drive 128. In addition, the peripheral flange 214 of the rotor drive 128 pushes the switch arm 220 downward so that the power supply is switched off. The timer 10 is thus switched to a selection mode.

In the selection mode, because the hub ratchet 124 engages the grooved surface 246 of the wiper drive 126, when the user rotates the control knob 147 and thus the shaft assembly 32, the shaft assembly 32 drives the wiper drive 126. However, the torque is not transmitted to the rotor drive 128 and the components below the rotor drive 128 because the protrusions 244 of the wiper drive 126 and the side grooves 216 of the rotor drive 128 are disengaged.

When the shaft assembly 32 is rotated to a position corresponding to a desired washing or operation cycle, the wiper drive 126 drives the conductive wiper 236 to contact the electrical circuit pattern 248. A detecting device (not shown), such as an encoder, embedded within the electrical circuit pattern, detects the angular position of the shaft assembly 32 through the conductive wiper 236. The detecting device then transmits a signal of the angular position of the shaft assembly 32 to the microprocessor, which determines which washing cycle has been selected according to a predetermined program.

Because the torque from the shaft assembly 32 is not transmitted to the rotor drive 128 and hence the cam device 18, the control knob 147 can be rotated both clockwise and counter clockwise to a desired position without being restrained by the cam device 18, as is often the case in the conventional electromechanical timer. The bi-directional rotation of the shaft assembly 32 in the selection mode makes it easier to select a washing cycle without the need to rotate almost the entire cycle to reach a position furthest from the starting position as is the case when the shaft assembly is allowed to rotate in only one direction.

Once a desired washing cycle is selected, the user pulls the shaft assembly 32 out to cause the hairpin spring 144 to engage the lower groove 164, as shown in FIG. 45. At the same time, the hub ratchet 124 is moved away from the grooved surface 246 of the index plate 232, thereby disengaging from the wiper drive 126. The axial movement of the shaft assembly 32 also causes the rotor drive 128 to move up so that the side grooves 216 of the rotor drive 128 engage the protrusions 244 of the wiper drive 126, thereby the rotor drive 128 driving the wiper drive 126 when the rotor drive 128 rotates. Further, the axial movement of the rotor drive 128 also releases the switch arm 220 to its initial open position to signal the microprocessor to start. The microprocessor then instructs the motor 20 to rotate the cam device 18 and/or the hub 120 to the correct position.

In the operation mode, because the hub ratchet 124 does not engage the wiper drive 126, the rotation of the shaft assembly 32 has no effect on the wiper drive 126, making the control knob 147 and the shaft assembly 32 free-wheeling.

As previously described, when the motor 20 rotates counter clockwise, the driving wheel 84 and hence the upper ratchet 130 and the lower ratchet 132 are driven clockwise. The cam device 18 is thus driven clockwise by the lower ratchet 132 to raise or lower the switch arms 100, 102, 104 of the switch assembly 16 for opening and closing the plurality of electric circuits associated with the plurality of appliance functions. In the meantime, the upper ratchet 132 slips relative to the rotor drive 128 and does not drive the rotor drive 128, as well as the components above the rotor drive 128.

When an appliance function is still being performed, the microprocessor instructs the motor 20 to rotate clockwise to drive the dial skirt (not shown) attached to the upper hub 120 to indicate the operational status. As described earlier, when the motor 20 rotates clockwise, the driving wheel 84 is driven counter clockwise. The rotation of the driving wheel 84 in the counter clockwise direction has no effect on the cam device 18, because the lower ratchet 130 slips relative to the toothed portion 88 of the cam device 18. Therefore, the electrical circuits controlled by the switch assembly 16 remain closed or opened to perform the first appliance function despite the motor's changing direction. However, the rotation of the driving wheel 84 in the counter clockwise direction drives the rotor drive 128, which in turn drives the wiper drive 126, the rear hub 122 and the front hub 120 and finally, the dial skirt mounted on the front hub 120. The dial skirt is thus moved to a proper position to indicate the operational status of the washing machine. The amount of rotation of the dial skirt is controlled by the microprocessor.

After the dial skirt is rotated to a proper position to indicate the operational status, the microprocessor can instruct the motor 20 to rotate counter clockwise any time before the first appliance function is completed, depending on the programming of the microprocessor and the predefined patterns of the cam device 18. When the motor 20 changes direction, the cam device 18 is driven again and causes another set of electrical circuits to close or open to perform a second appliance function. When the second appliance function is still being performed, the microprocessor instructs the motor 20 to rotate clockwise to drive the dial skirt to a second position indicating the second appliance function.

The motor 20 is repeatedly instructed by the microprocessor to rotate counter clockwise to drive the cam device 18 and clockwise to drive the dial skirt to indicate the operational status until all the appliance functions within the selected washing cycle are completed.

Unlike the conventional timer, the timer 10 according to the present disclosure does not drive the dial skirt continuously, because the dial skirt is not driven synchronously with the cam device 18 as is the case in the conventional electromechanical timer. Rather, the motor 20 drives the dial skirt intermittently to a plurality of discrete positions indicating the plurality of appliance functions. Since the control is performed by the microprocessor, the timer 10 is operated like an electronic timer, however, without costly relays.

The cam device 18 does not completely control the washing cycle of the washing machine as that in an electromechanical timer. The rotation of the motor 20, the cam device 18 and the dial skirt is subject to the control of the microprocessor. The cam device 18 functions like a switch to open and close the plurality of electric circuits through the switch assembly 16. Therefore, designing the cam device 18 is relatively easy compared with that for an electromechanical timer. When a new washing cycle is desired, it is easy to reprogram the electric circuits without changing the design of the entire control system, including the cam device 18.

The cam device 18 can be made to have multiple sets of surface patterns in one circle. Therefore, the cam device 18 does not need to be driven an entire cycle in order to put the cam device in a start position.

The timer 10 according to the present disclosure is a hybrid electromechanical and electronic timer, where the control is achieved by a microprocessor with the help of a cam device 18. Given the use of the control knob 147 and the shaft assembly 32 to select various washing cycles, the timer 10 is more acceptable to consumers, like an electromechanical timer. The timer 10 according to the present disclosure has both the advantages of an electronic timer and an electromechanical timer, including precise control, easy programming, bi-directional operation of the control knob in the selection mode, easy operation, cost effective, energy saving and acceptability by consumers.

It should be noted that while the timer 10 has been described to be used with a clothes washing machine, the timer 10 can be used with other appliances, such as clothes dryers, microwave ovens, while not departing from the spirit of the present disclosure.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A timer comprising:

a switch assembly for controlling a plurality of appliance functions;

a display device; and a bi-directional motor for operating the switch assembly and the display device, wherein when the motor rotates in a first rotational direction, the motor operates the switch assembly, and when the motor rotates in a second rotational direction opposite to the first rotational direction, the motor operates the display device.

2. The timer according to claim 1, wherein the timer is operable in a selection mode and an operation mode, and the motor rotates in both the first rotational direction and the second rotational direction when the timer is in the operation mode.

3. The timer according to claim 1, further comprising a microprocessor for controlling the motor.

4. The timer according to claim 1, further comprising a cam device for operating the switch assembly, wherein when the motor rotates in the first rotational direction, the motor drives the cam device to operate the switch assembly.

5. The timer according to claim 4, wherein the display device and the cam device are separately driven.

6. The timer according to claim 4, further comprising a first ratchet for driving the cam device and a second ratchet for driving the display device, wherein the first ratchet and the second ratchet are driven by the motor.

7. The timer according to claim 6, wherein when the motor rotates in the first rotational direction, the second ratchet slips relative to the display device so that the display device is not driven and when the motor rotates in the second rotational direction, the first ratchet slips relative to the cam device so that the cam device is not driven.

8. The timer according to claim 1, wherein the display device includes a dial skirt.

9. The timer according to claim 8, wherein the dial skirt is driven in an intermittent manner to a plurality of discrete positions.

10. The timer according to claim 1, further comprising a shaft assembly operable by a user and a detecting device for detecting an angular position of the shaft assembly when the shaft assembly is rotated in a selection mode.

11. The timer according to claim 10, wherein the motor is controlled based on the angular position of the shaft assembly in the selection mode.

12. The timer according to claim 10, wherein the detecting device includes an encoder.

13. A data input and display system for a timer operable in a selection mode and an operation mode, the data input and display system comprising:

a display device including a plurality of positions corresponding to a plurality of appliance functions;

a shaft assembly operable to select an operation cycle in the selection mode;

wherein the shaft assembly is rotatable in both a first rotational direction and a second rotational direction opposite to the first rotational direction in the selection mode; and a clutch adapted to connect a switch assembly and a motor, wherein the clutch disengages the display device in the selection mode and engages the display device in the operation mode.

14. The data input and display device according to claim 13, wherein the display device further includes a dial skirt.

15. The data input and display device according to claim 14, further comprising a microprocessor for controlling rotation of the dial skirt.

16. The data input and display device according to claim 13, wherein the display device includes a wiper drive and a conductive wiper secured to the wiper drive for contracting an adjacent electrical circuit.

17. A data input and display system for a timer operable in a selection mode and an operation mode, the data input and display system comprising:

a display device including a plurality of positions corresponding to a plurality of appliance functions;

a shaft assembly operable to select an operation cycle in the selection mode;

a clutch adapted to connect a switch assembly and a motor, wherein the clutch disengages the display device in the selection mode and engages the display device in the operation mode; and a hub ratchet secured to the shaft assembly for engaging the display device.

18. The data input and display device according to claim 17, wherein the hub ratchet engages the display device in the selection mode and disengages the display device in the operation mode.

19. The data input and display device according to claim 18, wherein the display device includes a grooved surface for engaging the hub ratchet.

20. The data input and display device according to claim 19, wherein the grooved surface and the hub ratchet are disposed axially opposed to each other.

21. The data input and display device according to claim 17, wherein the shaft assembly is movable in a first axial direction corresponding to the selection mode, and a second axial direction corresponding to the operation mode.

22. The data input and display device according to claim 21, wherein when the shaft assembly is moved in the first axial direction, the display device can be rotated by the shaft assembly.

23. A data input and display system for a timer operable in a selection mode and an operation mode, the data input and display system comprising:

a display device including a plurality of positions corresponding to a plurality of appliance functions;

a shaft assembly operable to select an operation cycle in the selection mode;

a clutch adapted to connect a switch assembly and a motor, wherein the clutch disengages the display device in the selection mode and engages the display device in the operation mode; and wherein the clutch includes at least one groove and the display device includes at least one protrusion, and wherein the at least one protrusion and the at least one groove engage in the operation mode and disengage in the selection mode.

* * * * *